US006257182B1

(12) United States Patent
Hara et al.

(10) Patent No.: US 6,257,182 B1
(45) Date of Patent: Jul. 10, 2001

(54) ELECTROMAGNETIC DRIVE SYSTEM FOR ENGINE VALVE

(75) Inventors: Seinosuke Hara; Makoto Nakamura; Yoshihiko Yamada; Tsutomu Hibi; Katsuhisa Todoroki; Yoshiaki Miyazato, all of Kanagawa (JP)

(73) Assignee: Unisia Corporation, Atsugi (JP)

( * ) Notice: Subject to any disclaimer, the term of this patent is extended or adjusted under 35 U.S.C. 154(b) by 0 days.

(21) Appl. No.: 09/430,131

(22) Filed: Oct. 29, 1999

(30) Foreign Application Priority Data

Oct. 30, 1998 (JP) ..... 10-310081
Jun. 23, 1999 (JP) ..... 11-176321

(51) Int. Cl.[7] ..... F01L 9/04

(52) U.S. Cl. ..... 123/90.11; 251/129.1; 251/129.16

(58) Field of Search ..... 123/90.11, 90.49; 251/129.01, 129.05, 129.1, 129.15, 129.16

(56) References Cited

U.S. PATENT DOCUMENTS 4,762,095 * 8/1988 Mezger et al. ..... 123/90.11
4,777,915 * 10/1988 Bonvallet ..... 123/90.11
4,878,464 * 11/1989 Richeson, Jr. et al. ..... 123/90.11
4,883,025 * 11/1989 Richeson, Jr. ..... 123/90.11
5,223,812 * 6/1993 Kreuter ..... 335/256
5,636,601 6/1997 Moriya et al. ..... 123/90.11
5,762,035 * 6/1998 Schebitz ..... 123/90.11
5,775,278 7/1998 Moriya et al. ..... 123/90.11
5,799,630 9/1998 Moriya et al. ..... 123/90.11
5,799,926 9/1998 Moriya et al. ..... 251/129.1
6,003,481 * 12/1999 Pischinger et al. ..... 123/90.11
6,101,992 * 8/2000 Pischinger et al. ..... 123/90.11

FOREIGN PATENT DOCUMENTS 8-21220 1/1996 (JP) .

* cited by examiner

*Primary Examiner*—Weilun Lo
(74) *Attorney, Agent, or Firm*—Foley & Lardner

(57) ABSTRACT

An electromagnetic drive system for repeatedly opening and closing a valve of an internal combustion engine is comprised of an electromagnetic drive mechanism and a damper mechanism. The electromagnetic drive mechanism comprises a pair of electromagnets, an armature disposed between the electromagnets and a pair of springs setting the armature at a neutral position between the electromagnets when both the electromagnets are de-energized. The electromagnets are alternately energized and de-energized according to a control signal. The damper mechanism is interlocked with the electromagnetic drive mechanism and functions to decrease a speed of displacement of the valve at a terminating period of each of a valve-closing stroke and a valve-opening stroke of the valve.

17 Claims, 19 Drawing Sheets

ELECTROMAGNETIC DRIVE SYSTEM FOR ENGINE VALVE

BACKGROUND OF THE INVENTION

The present invention relates an electromagnetic drive system for opening and closing intake valves and exhaust valves of an internal combustion engine for automobiles.

A Japanese Patent Provisional Publication No. 8-21220 discloses a typical electromagnetic drive system constituted by an electromagnetic drive mechanism and a control unit. The electromagnetic drive mechanism is basically constituted by an armature directly connected to an intake valve, a pair of electromagnets and a pair of springs. The control unit receives information indicative of an engine operating condition from various sensors and outputs a control current to the electromagnetic drive mechanism according to the engine operating condition indicative information. The electromagnets are alternately energized and de-energized to repeatedly open and close the intake valve according to the engine operating condition indicative information.

SUMMARY OF THE INVENTION

However, this conventional electromagnetic drive system has several characteristics to be improved. For example, although the attracting force of the electromagnet is radically increased according to the decrease of a distance between the armature and the electromagnet, spring force of the spring against the attracting force of the electromagnet is linearly increased. Therefore, at a terminating period of a valve-closing stroke, the intake valve may radically collide with the valve seat, and at a terminating period of a valve-opening period, the armature may radically collide with the electromagnet. Further, since this conventional electromagnetic drive system is integrally installed to the intake valve, assembly of this system to an engine requires complicated steps.

It is therefore an object of the present invention to provide an improved electromagnetic drive system which solves the above-mentioned drawbacks.

An electromagnetic drive system according to the present invention functions to repeatedly open and close a valve of an internal combustion engine and comprises an electromagnetic drive mechanism and a damper mechanism. The electromagnetic drive mechanism comprises a pair of electromagnets, an armature disposed between the pair of electromagnets and a pair of springs setting the armature at a neutral position between the electromagnets when both the electromagnets are de-energized. The electromagnets are alternately energized and de-energized according to a control signal. The damper mechanism is interlocked with the electromagnetic drive mechanism and functions to decrease a speed of displacement of the valve at a terminating period of each of a valve-closing stroke and a valve-opening stroke of the valve.

BRIEF DESCRIPTION OF THE DRAWINGS

In the drawings, like reference numerals denotes like elements and parts throughout all figures, in which.

DETAILED DESCRIPTION OF THE INVENTION

Referring to FIGS. 1 to 7B, there is shown a first embodiment of an electromagnetic drive system for engine valves according to the present invention.

Figure 1:
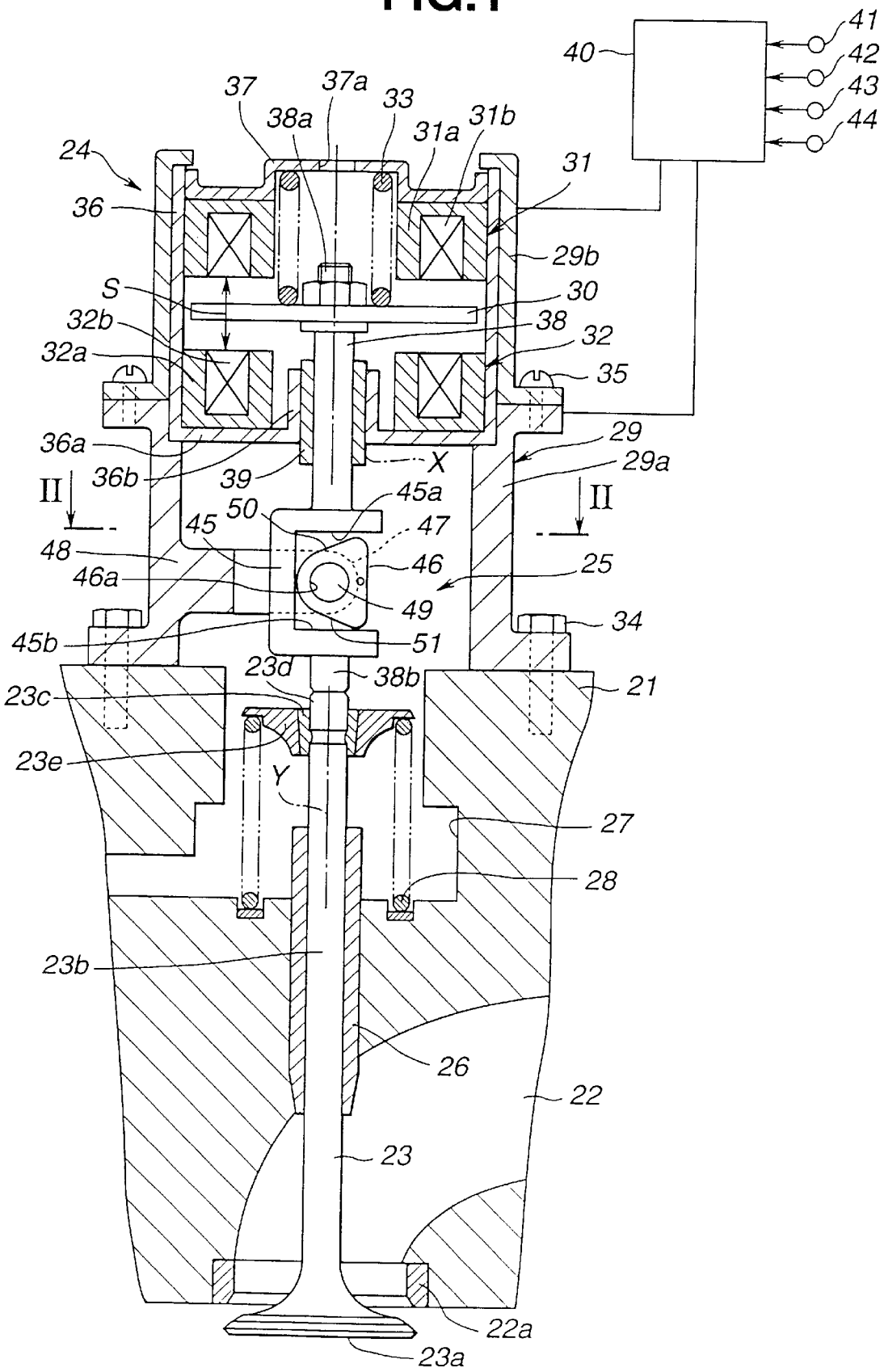
FIG. 1 is a cross-sectional view showing a first embodiment of an electromagnetic drive system according to the present invention.

As shown in FIG. 1, the electromagnetic drive system according to the present invention is installed to a cylinder head 21 of an engine to operate an intake valve 23 for opening and closing an intake port 22 of the cylinder head 21. The electromagnetic drive system comprises an electromagnetic drive mechanism 24 for driving the intake valve 23, and a damper mechanism 25 installed between the intake valve 23 and the electromagnetic drive mechanism 24.

The intake valve 23 is constituted by a round head 23*a* which is directly in contact with an annular valve seat 22*a* installed at an opening end of the intake port 22 and a valve stem 23*b* extending from a center portion of the round head 23*a*. The valve stem 23*b* is slidably inserted to a valve guide 26 installed to the cylinder head 21. A retainer lock (cotter) 23*c* is provided at an end portion 32*d* of the valve stem 23*b* and supports a retainer 23*e*. A valve-closing spring 28 for biasing the intake valve 23 toward a closed state is installed between the retainer 23*e* and a supporting groove 27 of the cylinder head 21.

The electromagnetic drive mechanism 24 comprises a casing 29 disposed on the cylinder head 21, a disc-shaped armature 30, a valve-closing electromagnet (V.C. magnet) 31, a valve-opening electromagnet (V.O. magnet) 32, a valve-opening spring 33 and the valve-closing spring 28. The armature 30 is disposed between the valve closing electromagnet 31 installed at an upper portion of the casing 29 and the valve-opening electromagnet 32 installed at a lower portion of the casing 29, as shown in FIG. 1. The armature 30 is movable between the valve-closing electromagnet 31 and the valve-opening electromagnets 32, and is biased by the valve opening spring 33 in an opening direction of the intake valve 23.

The casing 29 is constituted by a main body 29*a* made of metal and a cover 29*b* made of non-magnetic material. The main body 29*a* is fixed on the cylinder head 21 by means of fixing bolts 34. The cover 29*b* is fixedly installed on the main body 29 by means of screws 35. A cylindrical holder 36 made of non-magnetic material is fittingly installed in the cover 29*b*. The cylindrical holder 36 includes a bottom wall 36*a* on which the valve-opening electromagnet 32 is disposed. A cover 37 made of non-magnetic material is fixedly installed to an upper opening of the cylindrical holder 36. The cover 37 receives the valve-closing electromagnet 31 as shown in FIG. 1. A center portion of the cover 37 is depressed to receive the valve opening spring 33, and a hole 37*a* is formed at a center portion of the depressed portion of the cover 37.

The armature 30 is disposed between the valve-closing electromagnet 31 and valve-opening electromagnets 32 so that its upper and lower surfaces are faced with the valve-closing and valve-opening electromagnets 31 and 32, respectively. An end portion 38*a* of a guide rod 38 is fixed to a center portion of the armature 30 by means of a bolt and nut structure as shown in FIG. 1. A follower member 45 of the damper mechanism 25 is provided at an intermediate portion of the guide rod 39 integrally. The guide rod 38 slidably penetrates a cylindrical guide portion 39 fixedly installed to a cylindrical wall 36*b* formed at a center portion of the bottom wall 36*a*. The guide rod 38 is arranged such that a center axis X of the guide rod 38 is coaxial with a center axis Y of the intake valve 23. The other end portion 38*b* of the guide rod 38 is in contact with an end portion 23*d* of the valve stem 23*b*.

The valve closing electromagnet 31 is constituted by an annular core 31*a* of an U-shaped cross-section and an electromagnetic coil 31*b* installed in the core 31*a* as shown in FIG. 1. Similarly, the valve opening electromagnet 32 having an annular core 32*a* and an annular electromagnetic coil 32*b* whose constructions are basically the same as those of the annular core 31*a* and the electromagnetic coil 31*b*. The electromagnetic coils 31*b* and 32*b* receives ON-OFF signals from the control unit 40, respectively, to control the opening and closing operation of the intake valve 23. More specifically, when the electromagnetic coil 31*b* receives the ON signal and when the electromagnetic coil 32*b* receives the OFF signal from the control unit 40, the armature 30 is moved toward the valve closing electromagnet 31. On the other hand, when the electromagnetic coil 31*b* receives the OFF signal and when the electromagnetic coil 32*b* receives the ON signal from the control unit 40, the armature 30 is moved toward the valve opening electromagnet 31.

The valve opening spring 33 is installed between the depressed portion of the cover 37 and the upper surface of the armature 30 while being compressed therebetween. When both the valve closing and opening electromagnets 31 and 32 are de-energized, the spring force of the valve opening spring 33 is balanced with the spring force of the valve closing spring 28 to keep the armature 30 at a neutral position between the valve-closing electromagnet 31 and the valve-opening electromagnet 32. Therefore, at this de-energized state of both the electromagnets 31 and 32, the intake valve 23 is kept at an intermediate position which is a generally center between a full close position and a full open position of the intake valve 23.

The control unit 40 receives information indicative of an engine operating condition from various sensors. More specifically, the control unit 40 receives a crank angle indicative signal from a crank angle sensor 41 installed to the engine, an engine rotation speed indicative signal from an engine rotation speed sensor 42 installed to the engine, a signal indicative of a temperature of the valve closing solenoid 32 from a temperature sensor 43, and an air flow rate indicative signal from an airflow meter 44 installed in an intake system of the engine. The controller 44 outputs the control signals to the valve-closing electromagnet 31 and the valve-opening electromagnets 32, respectively, on the basis of the received information indicative of the engine operating condition to alternately and repeatedly turn on and off the valve-closing electromagnet 31 and the valve-opening electromagnet 32.

The detection value of a rotation angle detected at the crank angle sensor 41 is employed to synchronize the valve opening and closing timing of the intake valve 24 with the rotation of the crankshaft. The detection value of the rotation speed of the crankshaft, which is a detection value of the engine rotation speed sensor 42, is employed to adapt the valve operation to an energizing allowable time varied according to the rotation speed of the crankshaft. Further, the detection value of the temperature sensor 43 is employ to compensate the increase of the resistance of the electromagnetic coil 31*b* due to the increase of the temperature. The engine load detection value corresponding to an airflow rate detected by the airflow meter 44 and the engine rotation speed are employed to properly control opening-and-closing timing of the intake valve 23.

The damper mechanism 25 comprises the follower member 45 integrally connected to the guide rod 38, a swing cam 46 rotatably supported to a cam supporting shaft 49 of the casing 29 in the follower member 45, and a torsion coil spring 47 supporting the swing cam 46 to position the swing cam 46 at a neutral position. The follower member 45 is formed into a channel shape as shown in FIG. 1. An upper inner wall of the follower member 45 functions as a first follower surface 45*a* and a lower inner wall of the follower member 45 functions as a second follower surface 45*b*.

Figure 2:
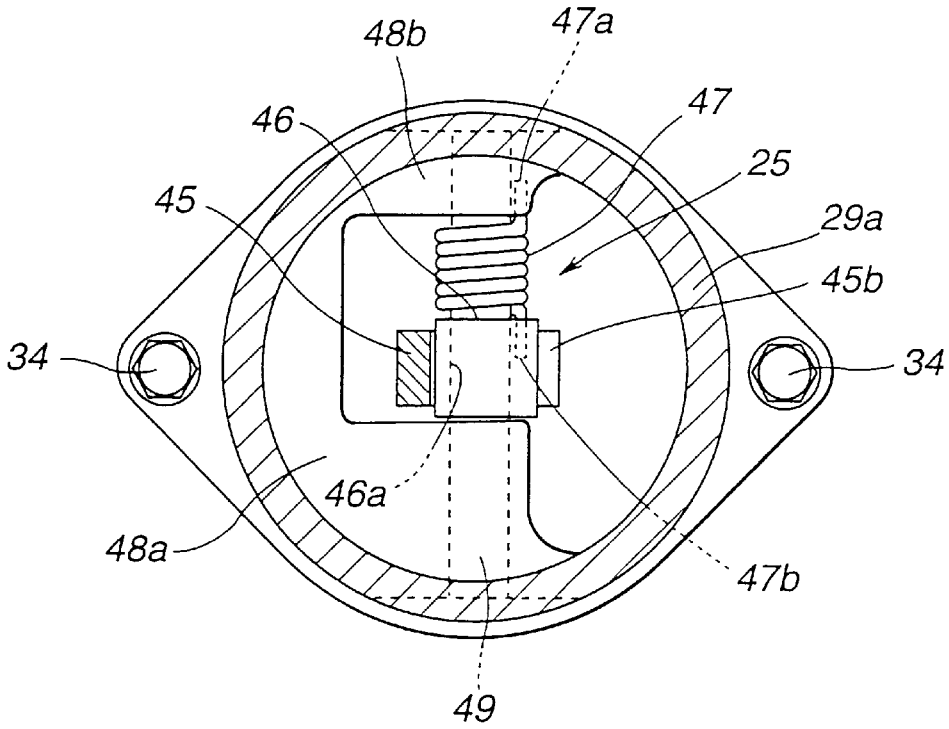
FIG. 2 is a cross-sectional view taken in the direction of arrows substantially along the lines II—II of FIG. 1.
Figure 3:
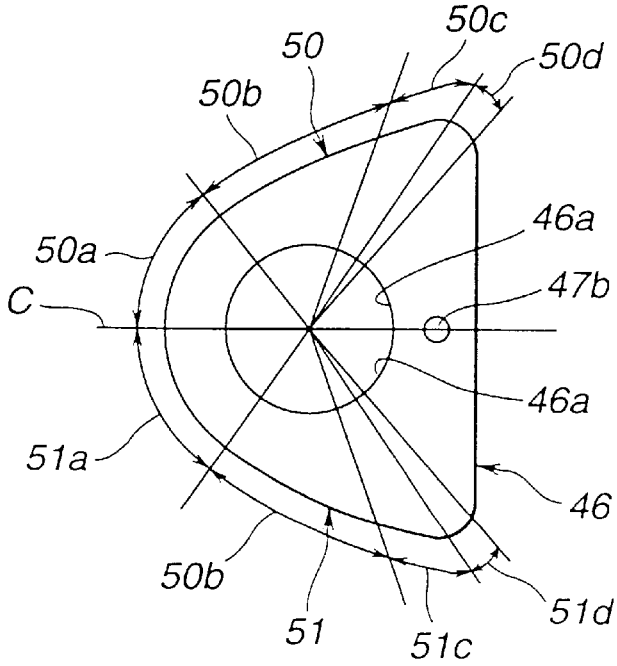
FIG. 3 is a plan view showing a swing cam employed in the first embodiment.

As shown in FIG. 2, a cam-supporting shaft 49 is inserted to a center hole 46*a* of the swing cam 46 so that the swing cam 46 is rotatable around the cam-supporting shaft 49. Both end portions of the cam-supporting shaft 49 are fixed to opposite boss sections 48*a* and 48*b* projected from an inner surface of the main body 29*a*. The swing cam 46 has first and second sector-shaped flat planes and a peripheral surface including a first cam surface 50 and a second cam surface 51, as shown in FIG. 3. The first cam surface 50 and the second cam surface 51 are symmetrical with respect to a centerline C shown in FIG. 3. The first cam surface 50 includes a first base circular part 50*a*, a fist ramp part 50*b*, a first lift part 50*c*, and a third ramp part 50*d* which are continuously arranged in order of mention. Similarly, the first cam surface 50 includes a second base circular part 51*a*, a second ramp part 51*b*, a second lift part 51*c*, and a fourth ramp part 51*d* which are continuously arranged in order of mention. A curve of the first lift part 50*c* is greater that that of the first ramp part 50*b*. Similarly, a curve of the second lift part 51*c* is greater that that of the second ramp part 51*b*.

Figure 4:
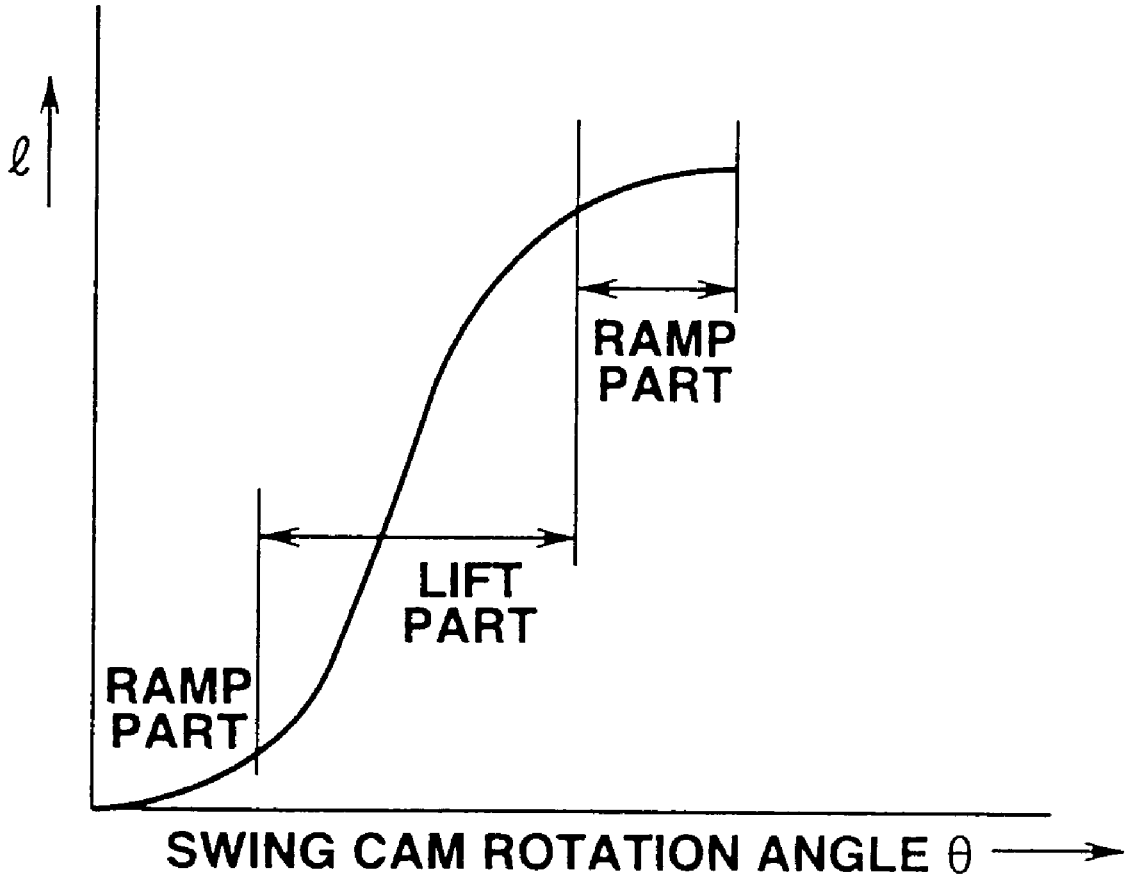
FIG. 4 is a graph showing a characteristic between a vertical stroke of an armature and an rotation angle of the swing cam of the first embodiment.

With this arrangement of the first and second cam surfaces 50 and 51, the lift curve of the follower member 45 with respect to the rotation angle θ forms a sigmoid curve as shown in FIG. 4. By the provision of the third and fourth ramp parts 50*d* and 51*d*, the switching between the operations of the first and second cam surfaces 50 and 51 is smoothly executed according to the switching of the vertical movement of the armature 30.

Further, the swing cam 46 is arranged to form a clearance Go between the armature 30 and the upper surface of the valve-opening electromagnet 32 when the first base circular part 50*a* of the first cam surface 50 is in contact with the upper inner surface 45*a* of the follower member 45. Further, the swing cam 46 is arranged to from a clearance Gc between the armature 30 and the lower surface of the valve-closing electromagnet 31 when the second base circular part 51*a* of the second cam surface 51 is in contact with the lower inner surface 45*b* of the follower member 45.

The torsion coil spring 47 is, as shown in FIG. 2, wound around the cam-supporting shaft 49, and one end portion 47*a* of the torsion coil spring 47 is fixed to the boss portion 48*b* and the other end 47*b* of the torsion coil spring 47 is fixed to the swing cam 46. The fixed portion of the other end 47*b* is located on the centerline C as shown in FIG. 3. By this arrangement of the torsion coil spring 47 to the swing cam 46, the swing cam 46 is always biased at a center portion of the swing locus of the swing cam 46 by the torsion coil spring 47.

Next, the manner of operation of the thus arranged electromagnetic drive system of the first embodiment according to the present invention will be discussed.

When the engine employing this electromagnetic drive system is stopped, the control unit 40 outputs no current signal to each electromagnetic coil 31*b*, 32*b* of each electromagnet 31, 32. That is, the valve-closing electromagnet 31 and the valve-opening electromagnet 32 are put in de-energized condition. Therefore, the armature 30 is positioned at the neutral position of the clearance S due to the springs 28 and 33, as shown in FIG. 1. Further, the intake valve 23 is set at a neutral position slight apart from the vale seat 22*a*. The swing cam 46 is position at a neutral position due to the spring force of the torsion coil spring 47. Therefore, the first and second lift parts 50*c* and 51*c* are faced with the follower surfaces 45*a* and 45*b*, respectively, while having a small clearance therebetween.

Figure 5:
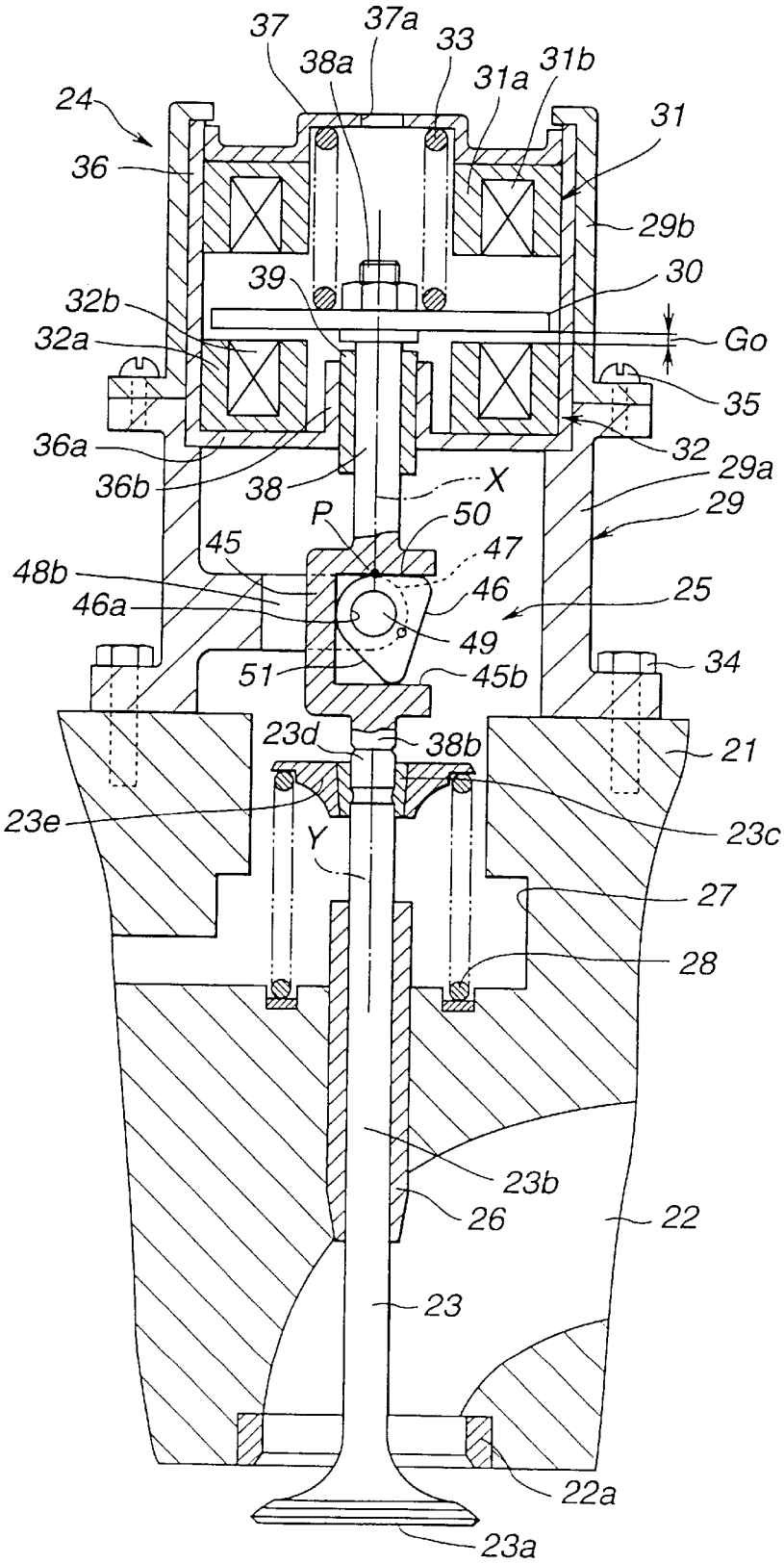
FIG. 5 is a cross-sectional view showing a valve open state of the first embodiment of FIG. 1.

When the engine is started and the current signal is outputted from the control unit 40 to the electromagnetic coil 32*a* of the valve-opening electromagnet 32, the armature 30 is attracted to the valve-opening electromagnet 32 as shown in FIG. 5, and therefore the armature 30 is pulled down by the attracting force of the valve-opening electromagnet 32 and the biasing force of the valve opening spring 33. The follower member 45 is pushed down through the guide rod 38, and the stem end 23*d* of the intake valve 23 is also pushed down. Therefore, the intake valve 23 is downwardly stroked against the biasing force of the valve-closing spring 28 to release the round head 23*a* from the valve seat 22*a*.

On the other hand, when the current signal is outputted to the electromagnetic coil 31*a* of the valve-closing electromagnet 31 while being not outputted to the electromagnetic coil 32*a* of the valve-opening electromagnet 32, the armature 30 is pulled up by the attracting force of the valve-closing electromagnet 31 and the spring force of the valve-closing spring 28 against the spring force of the valve-opening spring 33. This action pulls up the follower member 45. Therefore, the intake valve 23 is raised up by the spring force of the valve-closing spring 28 to fit the round head 23*a* with the valve seat 22*a*.

During this valve opening and closing period, the swing cam 46 is swung around the cam-supporting shaft 49 in clockwise and anticlockwise in FIG. 1. More specifically, when the follower member 45 is moved downward from a valve close state to release the round head 23*a* from the valve seat 22*a*, the swing cam 46 is swung clockwise in FIG. 1. That is, during a first half period of the valve opening stroke from the valve close state, the second cam surface 51 slides on the lower inner follower surface 45*b* to push the follower member 45 downwardly due to the biasing force of the torsion coil spring 47, and during a second half period of the valve opening stroke, the first cam surface 50 slides on the upper inner follower surface 45*a* to push the follower member 45 upwardly due to the biasing force of the torsion coil spring 47. Further, when the follower member 45 is moved upward to fit the round head 23*a* on the valve seat 22*a*, the swing cam 46 is swung anticlockwise in FIG. 1. That is, during a first half period of the valve closing stroke from the valve open state, the first cam surface 50 slides on the upper inner follower surface 45*a* to push the follower member 34 upwardly due to the biasing force of the torsion coil spring 47, and during a second half period of the valve closing stroke, the second cam surface 51 slides on the lower inner follower surface 45*b* to push the follower member 45 downwardly due to the biasing force of the torsion coil spring 47.

Figure 7A:
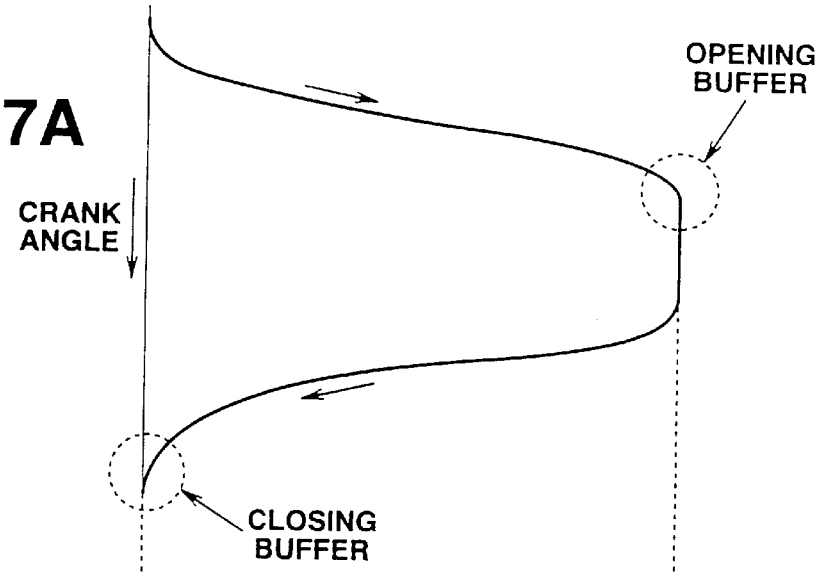
FIG. 7A is a graph showing a valve opening and closing timing of an intake valve of the first embodiment.

This operation of the swing cam 46 moves the intake valve 23 with respect to the crank angle as shown in FIG. 7A. Particularly, during a period near a fully opened state of the intake valve 23 and a period near a fully closed state of the intake valve 23, the speed of the stroke of the intake valve 23 is decreased due to the operation of the swing cam 46 with respect to the follower member 45 to perform buffering effect in areas shown by dotted-line circles of FIG. 7A.

When the intake valve 23 closes the intake port 22, the biasing force of the valve-opening and valve-closing springs 33 and 28 applied to the swing cam 46 becomes generally zero at the terminating period of the valve closing and valve opening strokes.

Figure 7B:
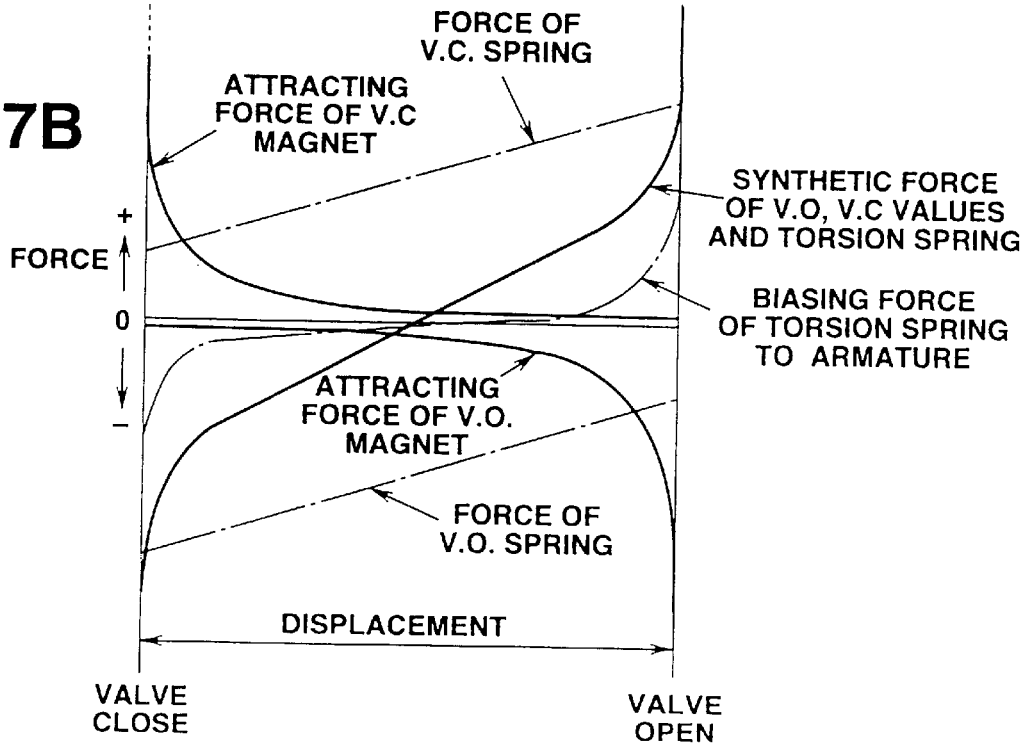
FIG. 7B is a graph showing characteristics of attracting forces of electromagnets and spring forces of springs employed in the first embodiment.

That is, when the intake valve 23 is moving to close the intake port 22, the contacting position P of the swing cam 46 to the follower cam surfaces 45*a* and 45*b* is moved from the second ramp part 51*b* to the base circular part 5la according to the raising and lowering of the follower member 45. Therefore, a force moment to be transmitted from the valve-closing spring 28 to the swing cam 46 approaches zero, and the spring force to be transmitted from the swing cam 46 to the guide rod 38 and the armature 30 approaches zero. Particularly, when the intake valve 23 is moved to close the intake port 22, the armature 30 receives the spring reaction force of the torsion coil spring 47 with the spring force of the valve-opening spring 33 so as to decrease the force directed to the valve-closing electromagnet 31. Therefore, the stroke speed of the armature 30 and the intake valve 23 at the terminating period of the valve-closing stroke is effectively damped. This damping effect is also ensured at the terminating period of the valve-opening stroke. Therefore, it is possible to mechanically suppress the radical movement of the armature 30 by means of the swing cam 46 including the first and second ramp parts 50*b* and 51*b* and the first and second base circular parts 50*a* and 51*a*. Consequently, the intake valve 23 performs a valve operation characteristic including a smooth and slow characteristic at the terminating period of the valve-opening and valve-closing strokes. In other words, the swing cam 46 is swung by the valve-opening and valve-closing springs 33 and 28 and the attraction force of the electromagnets 31 and 32, and the rotational moment caused by this swing of the swing cam 46 functions to decrease the stroke speed of the intake valve 23 and the armature 30. Therefore, the damping effect at the terminating period of the valve opening and closing stroke is ensured. Furthermore, the synthetic force of the spring force applied to the armature 30 by the valve-closing and valve-opening springs 28 and 33 and the torsion coil spring 47 is radically increased at a position near the uppermost position of the armature 30 and a position near a lowermost position of the armature 30 as shown in FIG. 7B. Therefore, this characteristic effectively functions as a damping force to the intake valve 23 at the terminating period of each of the valve-opening and valve-closing periods. Accordingly, the intake valve 23 ensures a stable damping function as shown by dotted-line circles of FIG. 7A. As a result, this arrangement functions to firmly prevent the radical collisions between the round head 23*a* and the valve seat 22*a* and between the armature 30 and each of the electromagnets 31 and 32 and to prevent the generation of noises, abrasions and breakages thereby.

Figure 6:
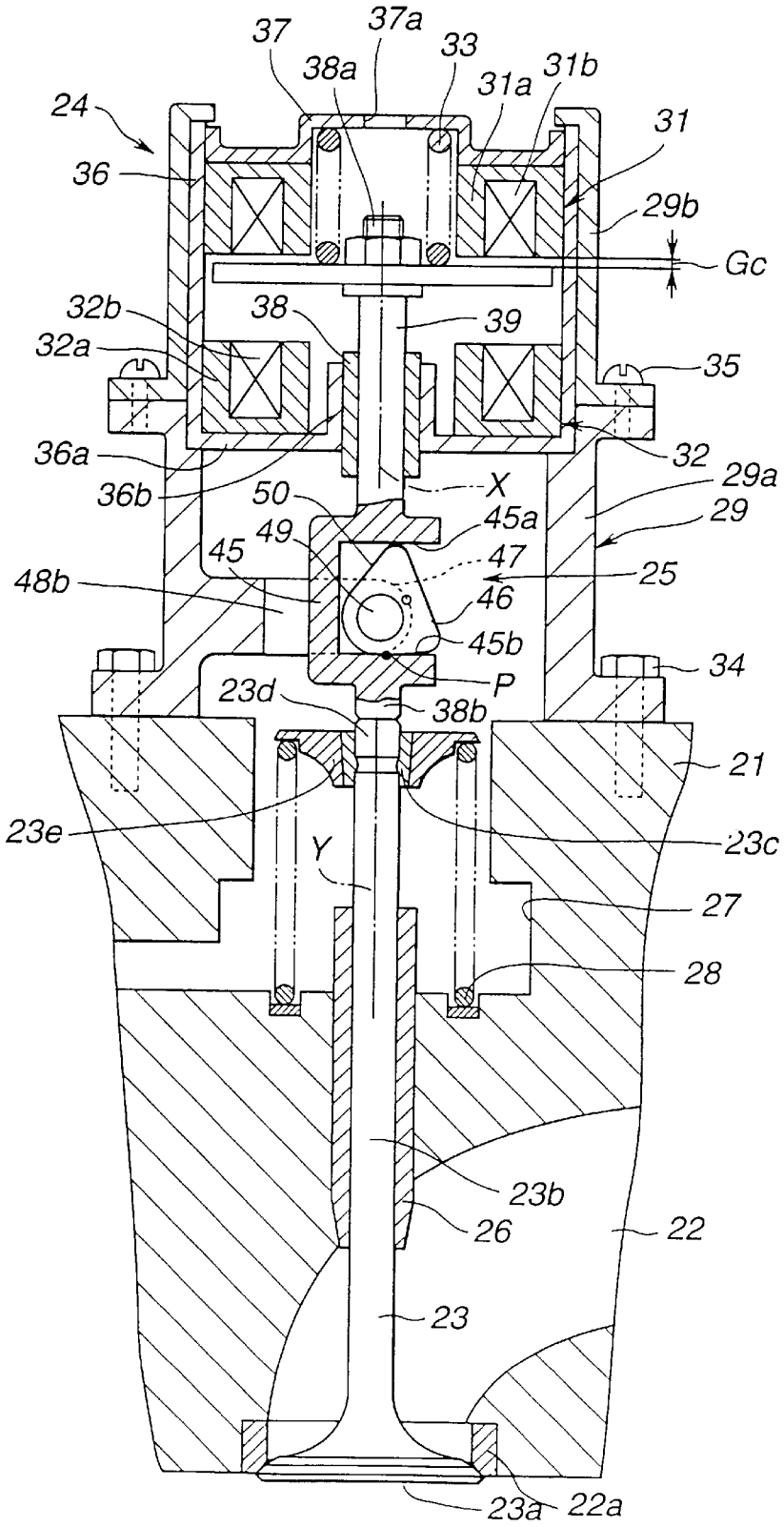
FIG. 6 is a cross-sectional view showing a valve full close state of the first embodiment of FIG. 1.

Furthermore, the slight clearances Go and Gc are positively provided between the armature 30 and the electromagnets 31 and 32 as shown in FIGS. 5 and 6 when the armature 30 is positioned at the lowermost position and the uppermost position. The collision between the armature 30 and the electromagnets 31 and 32 are further certainly prevented.

In this first embodiment, the electromagnetic drive mechanism 24 and the intake valve 23 are separately provided. Therefore, when the follower member 45 is not pushing the intake valve 23, that is, when a small clearance is being formed between the lower end portion 38*b* of the guide rod 38 and the stem end 23*d*, the intake valve 23 is stably and certainly biased to the closing direction by means of the valve-closing spring 28. This ensures a sealing fit between the round head 23*a* and the valve seat 22*a*.

Further, the arrangement of the intake valve 23 and the valve-closing spring 28 is basically the same as that of the conventional camshaft type valve mechanism. Therefore, it is possible to easily assembly the electromagnetic valve drive system according to the present invention to the cylinder head 21. Further, it is possible to integrally assemble the electromagnetic drive mechanism 24 and the damper mechanism 25 into the casing 29, or to previously assemble the electromagnetic drive mechanism 24 and the damper mechanism 25 into a unit and to assemble the unit to the casing 29. This facilitates conventional and delicate assembly steps to a cylinder head and improves the assemble ability of this system to the engine.

Referring to FIGS. 8 to 11, there is shown a second embodiment of the electromagnetic drive system according to the present invention.

The second embodiment is different from the first embodiment in a structure of the damper mechanism 25 and a structure of the follower member 55. Further, the electromagnetic drive system of the second embodiment employs two swing cams which are a first swing cam 56 for opening the intake valve 23 and a second swing cam 57 for closing the intake valve 23.

That is, the follower member 55 is formed into a disc shape, and a center portion of the follower member 55 is connected to a lower end portion 38*b* of the guide rod 38. The guide rod 38 is arranged such that its axis $X_0$ is offset from an axis Y of the valve stem 23*b* toward a right hand side by a predetermined distance Z as shown in FIG. 8.

Figure 8:
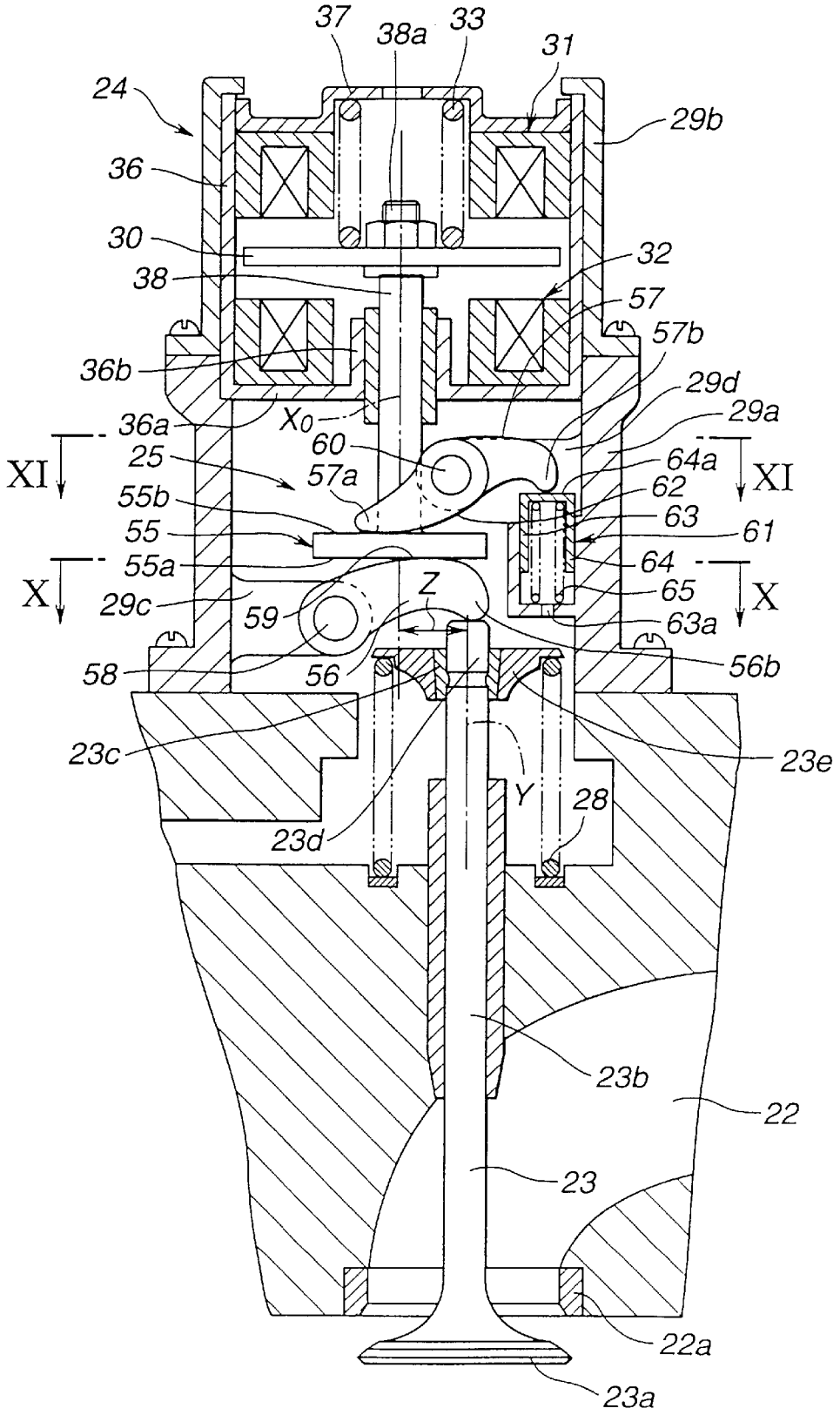
FIG. 8 is a cross-sectional view showing a second embodiment of the electromagnetic drive system according to the present invention.
Figure 9:
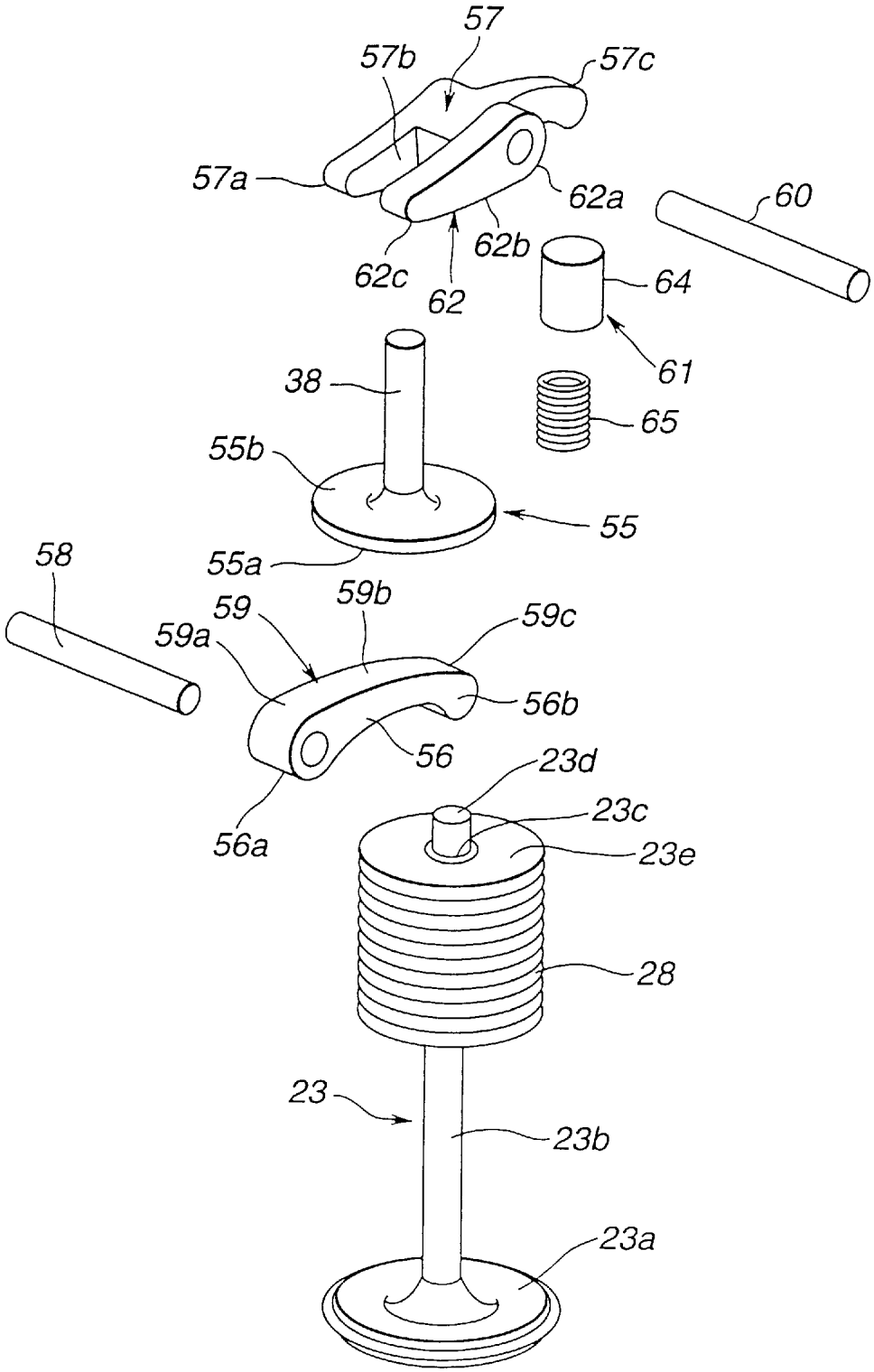
FIG. 9 is an exploded perspective view showing an essential part of the second embodiment.
Figure 10:
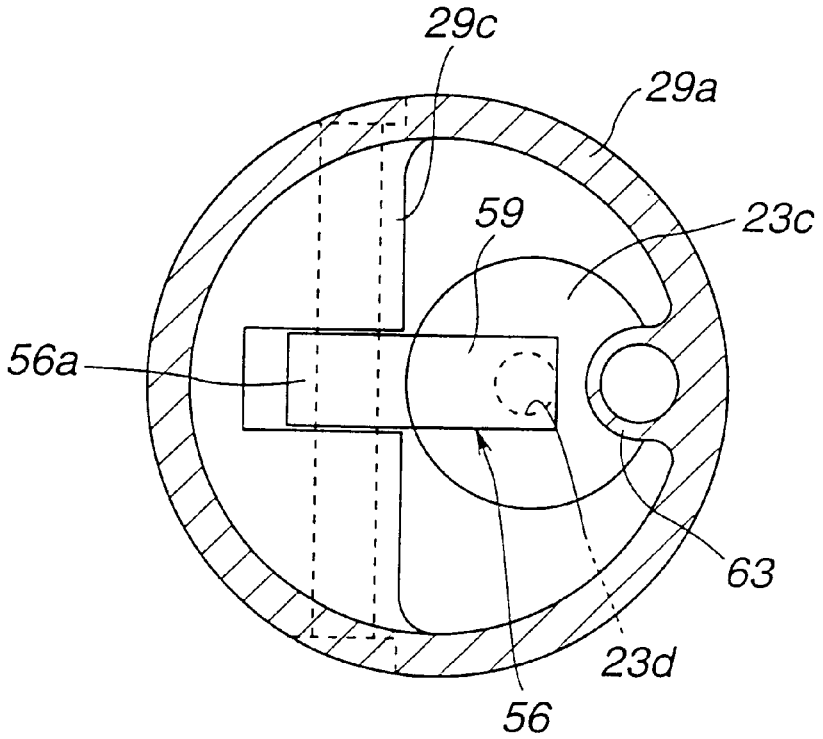
FIG. 10 is a cross-sectional view taken in the direction of arrows substantially along the line X—X of FIG. 8.
Figure 11:
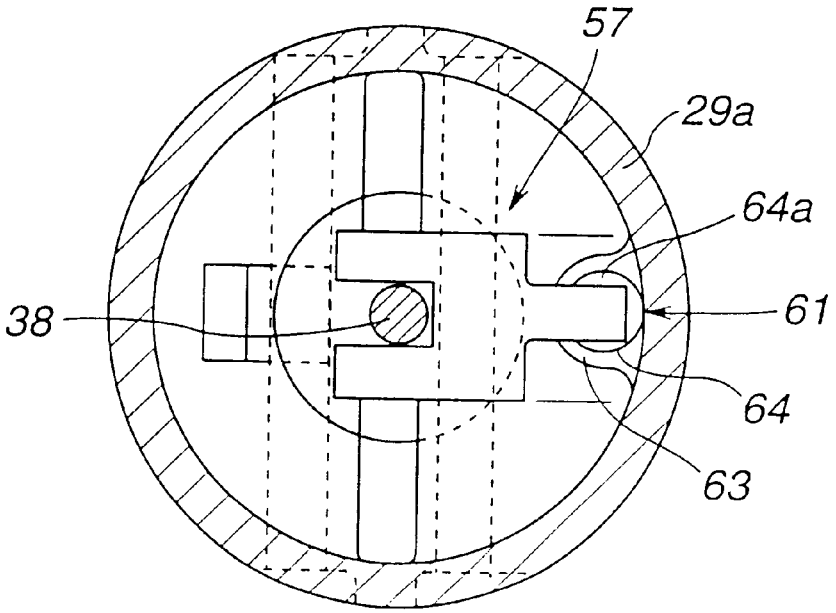
FIG. 11 is a cross-sectional view taken in the direction of arrows substantially along the line XI—XI of FIG. 8.

The first swing cam 56 is formed into an arc shape as shown in FIGS. 8 and 9. The first swing cam 56 is constituted by a base end portion 56*a* connected to the main body 29*a* and a swing end portion 56*b* in contact with the stem end 23*d*. The base end portion 56*a* is swingably supported to a first cam-supporting shaft 58 fixed to boss portions 29*c* of the main body 29*a*. An arc-shaped lower surface of the swing end portion 56*b* is in contact with the stem end 23*d* of the intake valve 23. Further, an arc-shaped upper surface of the first swing cam 56 functions as a first cam surface 59. The first cam surface 59 includes a base part 59*a* near the base end portion 56*a*, a first ramp part 59*b* continuous to the base part 59*a*, and a first lift part 59*c* near the swing end portion 56*b*. The first cam surface 59 is in contact with a lower surface (first follower surface) 55*a* of the follower member 55.

The second swing cam 57 is disposed at an upward position of the follower member 55 and has an arc shape as shown in FIGS. 8 and 9. The second swing cam 57 is swingably supported to a cam-supporting shaft 60 fixed to boss portions 29*d* of the main body 29*a*. The second swing cam 57 is constituted by a first end portion 57*a* divided into two arms and a second end portion 57*c* in contact with a biasing mechanism 61. The first end portion 57*a* has a pair of arms defining a penetrating groove 57*b* therebetween. A lower surface of the first end portion 57*a* functions as a second cam surface 62 which includes a base part 62*a* near a center of the second swing cam 57 and a second ramp part 62*b* continuous to the base part 62*a* and a lift part 62*c* continuous to the ramp part 62*c* and near a tip end of the first end portion 57*a*. The second cam surface 62 is in contact with an upper surface (second follower surface) 55*b* of the follower member 55.

The biasing mechanism 61 is constituted by a cylinder 63 provided vertically at an inner portion of the main body 29*a*, a plunger 64 disposed in the cylinder 63 and a spring 65 biasing the plunger 64 upwardly in the cylinder 63. The plunger 64 is vertically movable in the cylinder 63 while receiving the biasing force of the spring 65 upwardly. Therefore, a lower end surface of the second end portion 57*c* is elastically in contact with an upper surface 64*a* of the plunger 64. That is, the spring 65 functions to press the second follower surface 55*b* of the follower member 55 downwardly by means of the second cam surface 62 of the second swing cam 62. An air hole 63*a* is formed at a bottom wall of the cylinder 63 to smoothly slide the plunger 64.

Figures 14A, 14B:
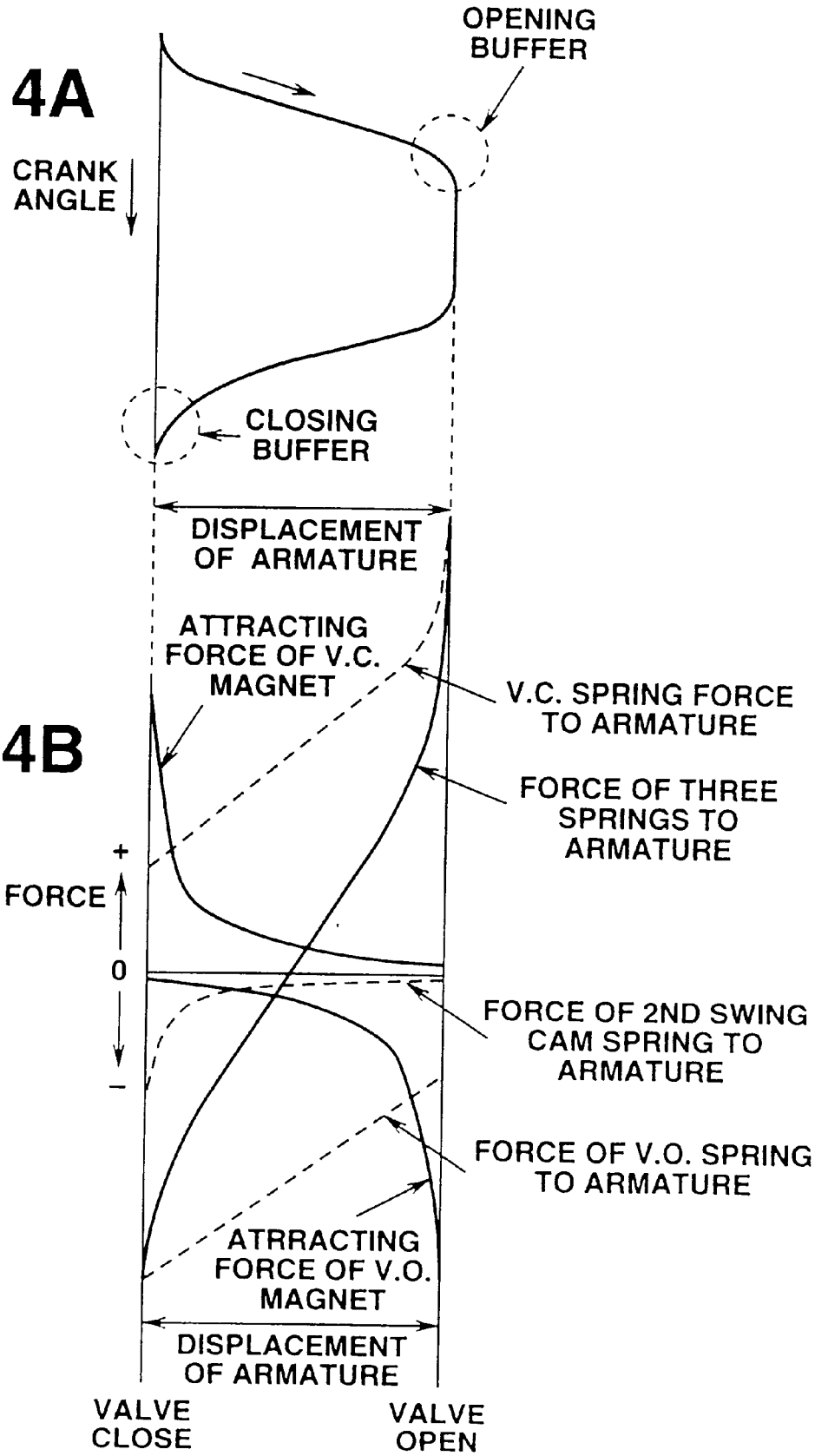
FIG. 14A is a graph showing a valve opening and closing timing of an intake valve of the second embodiment.
FIG. 14B is a graph showing characteristics of attracting forces of electromagnets and spring forces of springs employed in the second embodiment.

With reference to FIGS. 14A and 14B, the force balance among the attracting forces of the electromagnets 31 and 32 and the spring force of the springs 28 and 33 in the valve opening and closing period will be discussed.

In FIGS. 14A and 14B, a horizontal axis denotes a displacement of the armature 30. The displacement of the armature 30 depends on the arrangement of the first cam surface 59 so as to be about half of the lifting displacement of the intake valve 23. Therefore, the electromagnetic attracting force of both electromagnets 31 and 32 to be transmitted to the intake valve 23 is decreased to about half of it by the leverage of the first swing cam 56. In contrast, by the decrease of the displacement of the armature 30 to half, it becomes possible to increase the electromagnetic attracting force high such as four times since the characteristic of the electromagnetic attracting force performs such that the electromagnetic attracting force of each of the electromagnets 31 and 32 is in inverse ratio to the square of the distance between the armature 30 and each core 31*a*, 32*a* of each electromagnet 31, 32. Accordingly, it is possible to effectively utilize the electromagnets 31 and 32 by decreasing the stroke amount of the armature 30 by means of the leverage of the swing cam 56.

With the thus arranged second embodiment according to the present invention, when the engine is stopped, the armature 30 is positioned at a neutral position of the clearance between the electromagnets 31 and 32 due to the relative balance of the springs 28 and 33. Therefore, the intake valve 23 is positioned at a neutral position slightly apart from the valve seat 22*a* under this engine-stopped condition. At this timing, the first swing cam 56 is positioned such that the first cam surface 59 is in contact with the first follower surface 55*a* of the follower member 55 and the top end portion 56*b* is in contact with the stem end 23*d*. Further, the second swing cam 57 is positioned such that the second cam surface 62 is in contact with the second follower surface 55*b* of the follower 55 due to the spring force of the spring 65.

Figure 12:
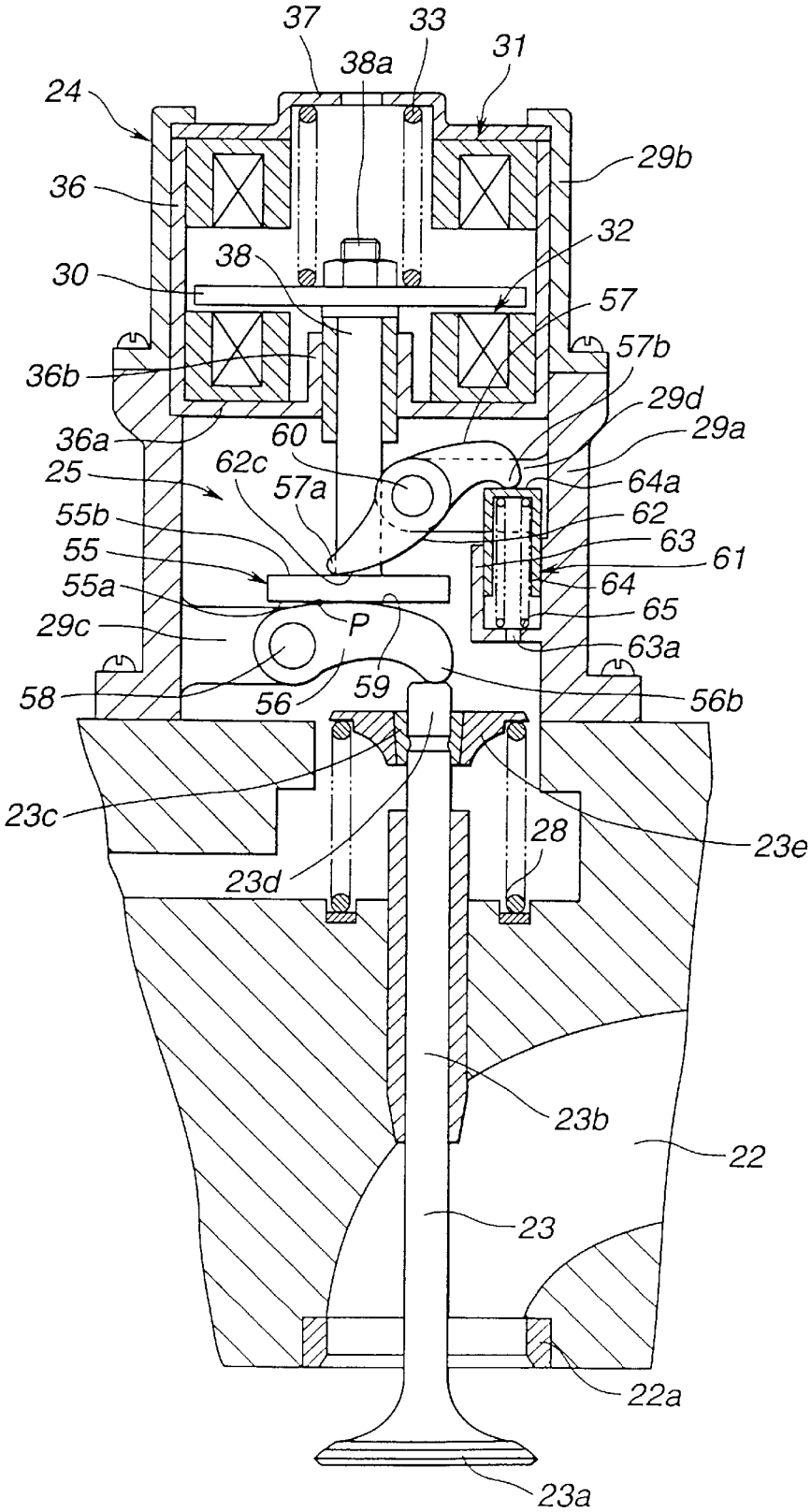
FIG. 12 is a cross-sectional view showing a valve full open state of the second embodiment of FIG. 8.

When the engine is started and when the armature 30 is moved down by the spring force of the valve-opening spring 33 and the valve-opening electromagnet 32 as shown in FIG. 12, the first swing cam 56 is swung clockwise in FIG. 12 according to the lowering of the guide rod 38 and the follower member 55. This clockwise swing of the first swing cam 56 pushes down the stem end 23*d* through the top end portion 56*b* to open the intake valve 23. At this moment, the first cam surface 59 is moved on the first follower surface 55*a* while changing its contacting position P from the first ramp part 59*b* to the base part 59*a*. By this movement of the contacting position P from the first ramp part 59*b* to the base part 59*a*, the damper effect is ensured at the terminating period of the valve opening stroke of the armature 30 and the intake valve 23. That is, at the terminating period of the valve opening stroke, the contacting position P of the first cam surface 59 is very close to the first cam-supporting shaft 58. Therefore, at this terminating period, the armature 30 is generally supported to the first cam-supporting shaft 58 through the follower member 55. This functions to suppress the radial lowering of the armature 30 in the valve-opening terminating period and to provide a slow stroke in this period.

Figure 13:
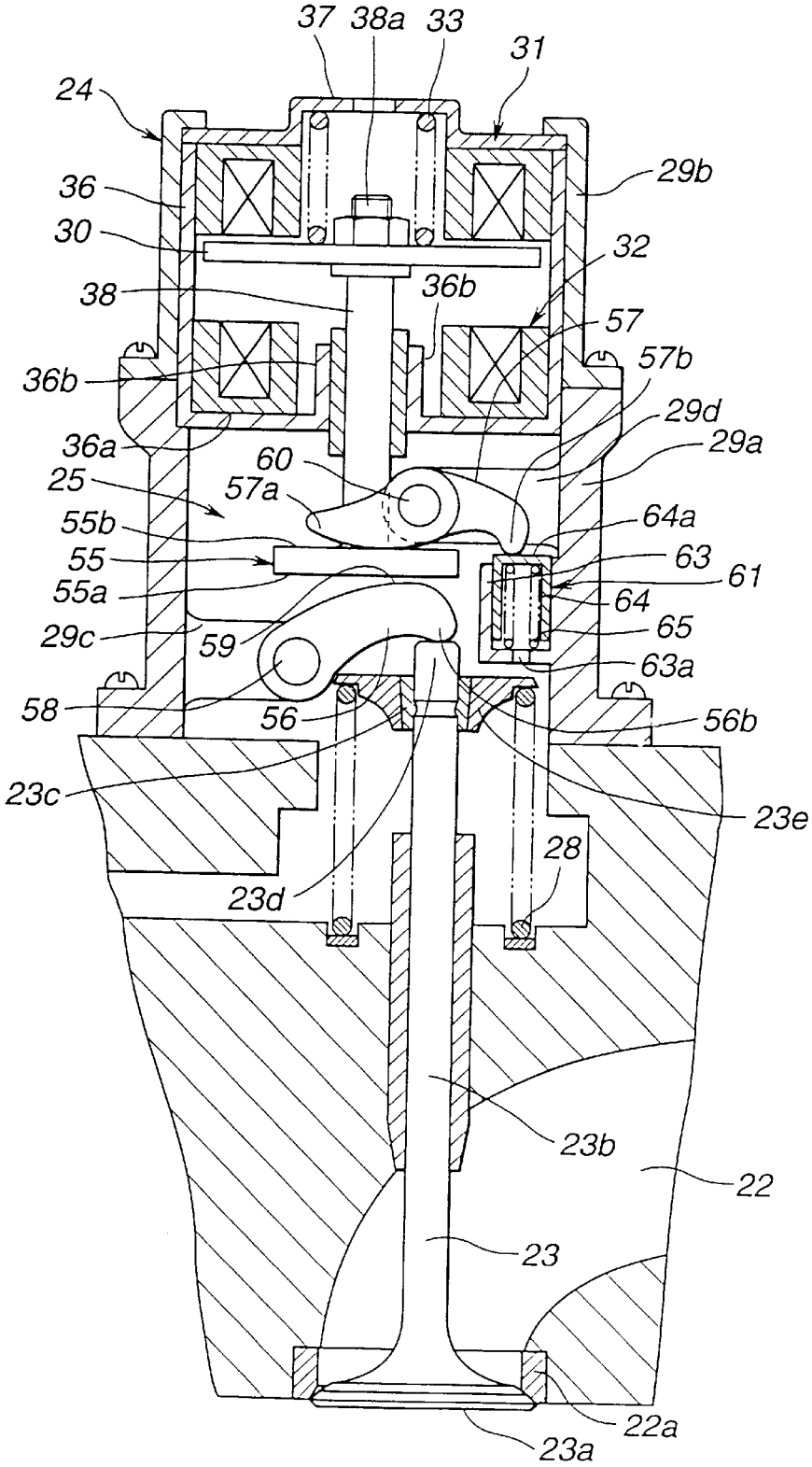
FIG. 13 is a cross-sectional view showing a valve full close state of the second embodiment of FIG. 8.

On the other hand, when the intake valve 23 is closed, that is, when the armature 30 is raised up by the spring force of the valve-closing spring 28 and the attracting force of the valve-closing electromagnet 31 as shown in FIG. 13, the first swing cam 56 is swung anticlockwise in FIG. 13 according to the raising of the follower member 55. Further, the second swing cam 57 is swung clockwise against the biasing force of the spring 65. At this period, the second cam surface 62 is moved on the second follower surface 55*b* from the second lift part 62*c* to the base part 62*a*. By this movement, the raising force of the intake valve 23 at the terminating period is generally supported to the second cam-supporting shaft 60. Therefore, the damper effect is ensured at the terminating period of the valve closing stroke of the armature 30 and the intake valve 23. That is, at the terminating period of the valve closing stroke, the spring force of the spring 65 functions to push down the armature 30 through the second swing cam 57 and the second follower surface 55*b* as shown in FIG. 14B. Consequently, the damping force is suitably applied to the armature 30 at the terminating period of the valve closing stroke.

With the thus arranged second embodiment according to the present invention, it is possible to decrease the stroke speed at a terminating period of the valve opening stroke and a terminating period of the valve closing stroke by means of the cam surfaces 59 and 62 and the spring 65 as shown in FIG. 14A. This functions to prevent the armature 30 from colliding with the electromagnets 31 and 32 and to prevent the intake valve 23 from colliding with the valve seat 22*a*, and therefore the noises and abrasion caused by this collision is prevented.

Figure 15:
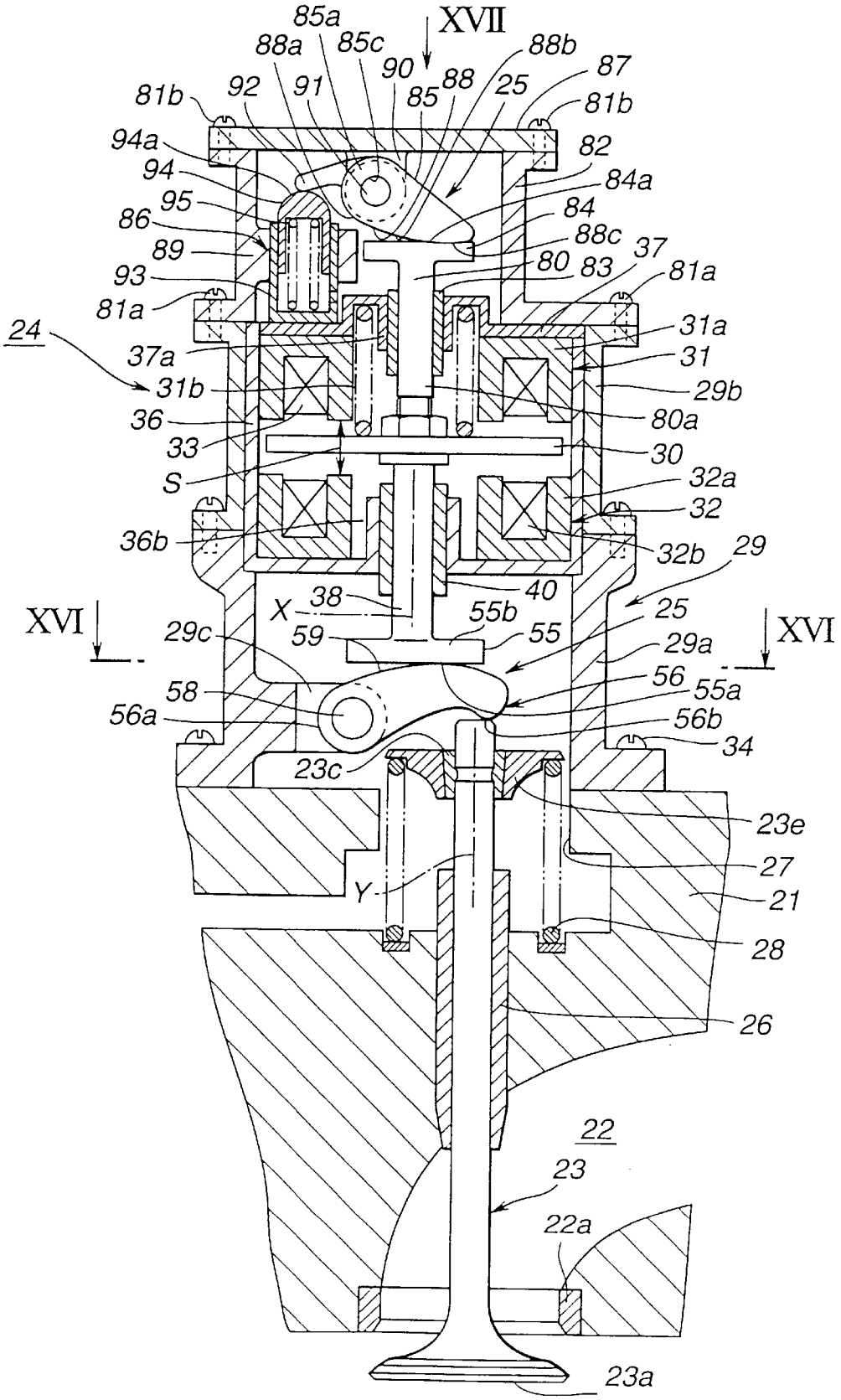
FIG. 15 is a cross-sectional view showing a third embodiment of the electromagnetic drive system according to the present invention.
Figure 16:
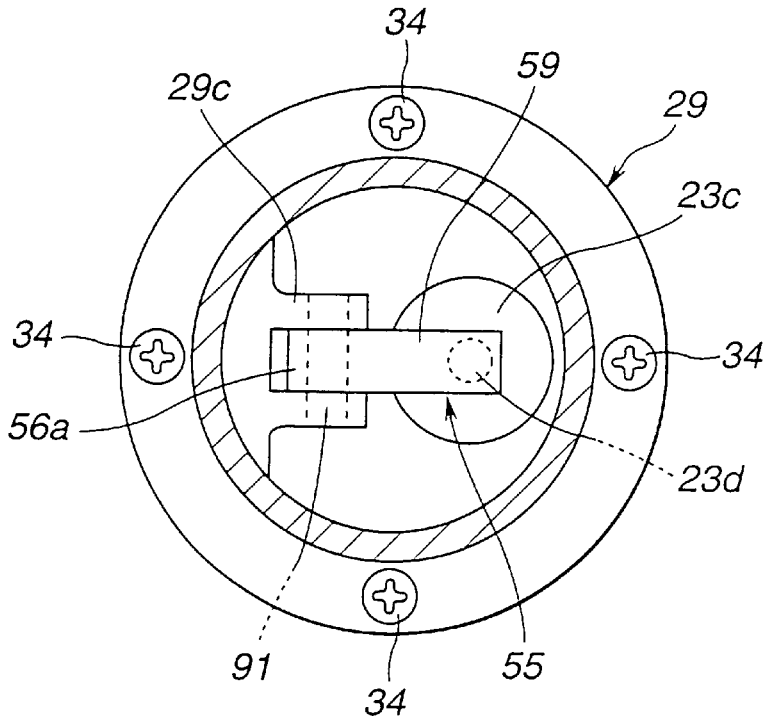
FIG. 16 is a cross-sectional view taken in the direction of arrows substantially along the line XVI—XVI of FIG. 15.
Figure 17:
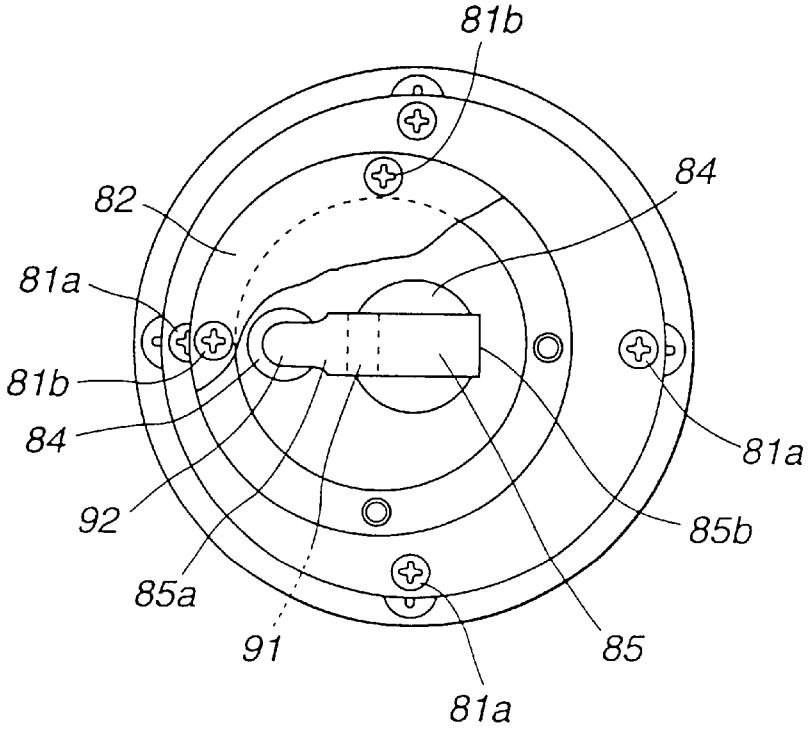
FIG. 17 is a view taken in the direction of an arrow XVII of FIG. 15.

Referring to FIGS. 15 to 17, there is shown a third embodiment of the electromagnetic drive system according to the present invention. Arrangements of the first follower member 55 and the first swing cam 56 are generally similar to those of the second embodiment. A second guide rod, a second follower member and a second swing cam are disposed in a second casing 82 provided at an upper portion of the casing 29.

The second casing 82 of a cylindrical shape is fixed at an upper portion of the casing 29 by means of screws 81*a*. A disc-shaped cover wall 87 is fixed to an upper end portion of the second casing 82 by means of screws 81*b*. A supporting wall 89 of a thick disc shape is integrally disposed at an inner wall of the second casing 82. A through hole is vertically formed at the supporting wall 89. A biasing mechanism 86 is installed in the through hole of the supporting wall 89.

The second guide rod 80 is slidably inserted to a cylindrical wall 37*a* installed in a center hole of the cover 37. A lower end portion 80*a* of the second guide rod 80 is in bud contact with the upper end portion 38*a* of the first guide rod 38.

A second follower member 84 of a disc shape is integrally connected to an upper end portion of the second guide rod 80. A second follower surface 84*a* is formed at an upper surface of the second follower member 84.

Figure 18:
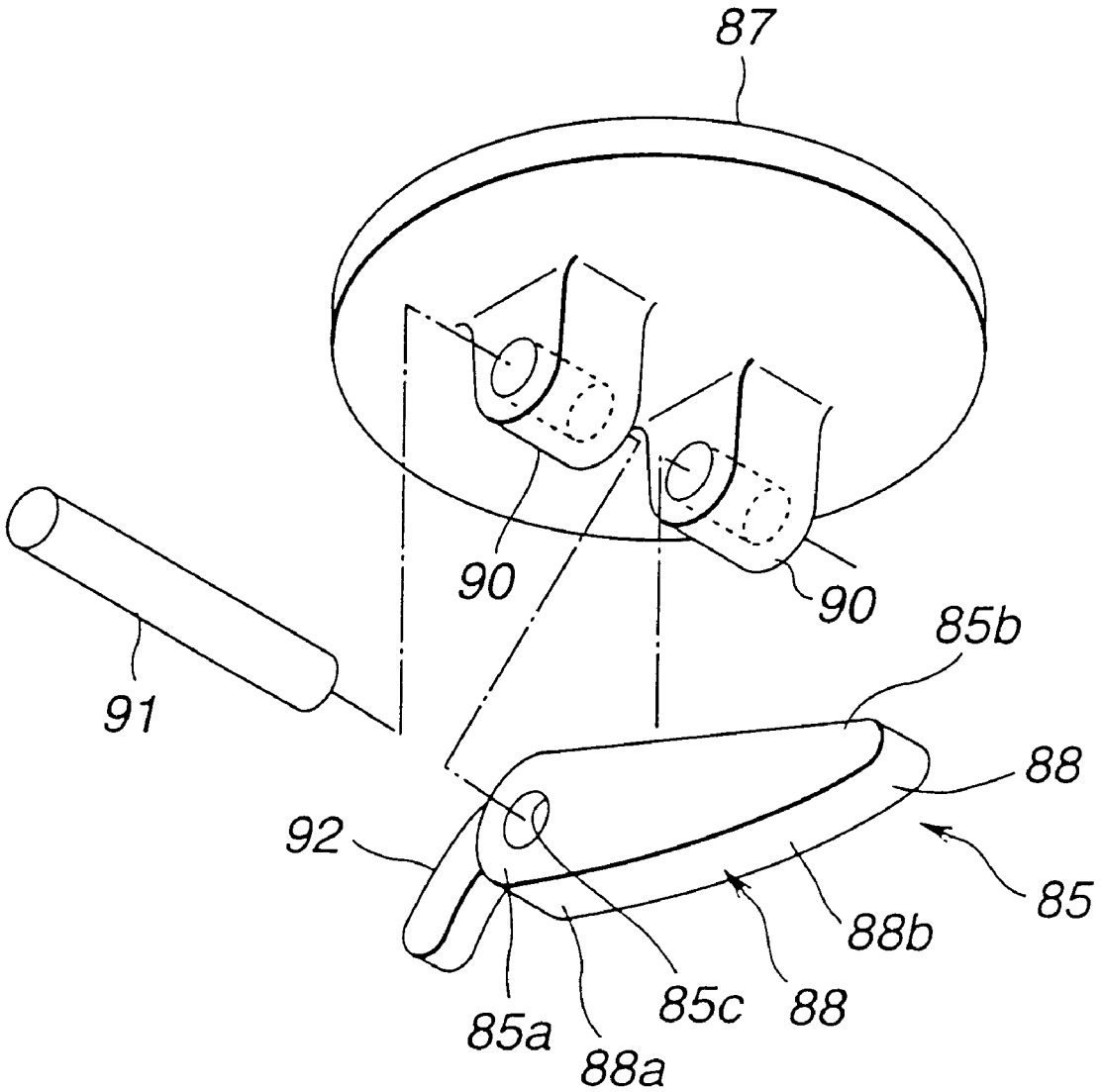
FIG. 18 is an exploded perspective view showing an essential part of the third embodiment.

The second swing cam 85 is generally formed into a teardrop shape, and is swingably supported to a second cam-supporting shaft 91. The second cam-supporting shaft is fixed to a pair of brackets 90, 90 integrally formed at a lower surface of the cover wall 87, as shown in FIG. 18. An arc-shaped second cam surface 88 of the second swing cam 85 is in contact with the second follower surface 84*a* of the second follower member 84. Further, the second swing cam 85 has a lever portion 92 extending from a portion near the second cam-supporting shaft 91 toward a left hand side in FIG. 15. A top end portion of the lever 96 is in contact with the biasing mechanism 86.

The biasing mechanism 86 comprises a cap shaped body member 93 press-fitted to the through hole of the supporting wall 89, a plunger 94 slidably disposed in the body member 93 and a coil spring 95 upwardly biasing the plunger 94. The plunger 94 has a spherical head 94*a*, which is in contact with the lever portion 92 of the second swing cam 85. The second swing cam 85 is always pushed by the plunger 94 to be swung clockwise in FIG. 15. More specifically, the second cam surface 88 is elastically in contact with the second follower surface 84*a* of the second follower member 84 due to the biasing mechanism 86, and therefore the second guide rod 80 is also elastically in contact with an upper end portion of the first guide rod 80. The coil spring 95 is arranged to generate small spring force.

With the thus arranged electromagnetic drive system of the third embodiment according to the present invention, when the engine is stopped, the armature 30 is kept at a neutral position of the clearance S between the electromagnets 31 and 32 due to the balance of the spring forces of the springs 28 and 33 as shown in FIG. 15. Therefore, the intake valve 23 is also kept at a neutral position slightly apart from the valve seat 22*a*. At this moment, a top end portion of the second cam surface 88 of the second swing cam 85 is elastically in contact with the second follower surface 84*a* of the second follower member 84 due to the biasing mechanism 86.

Figure 19:
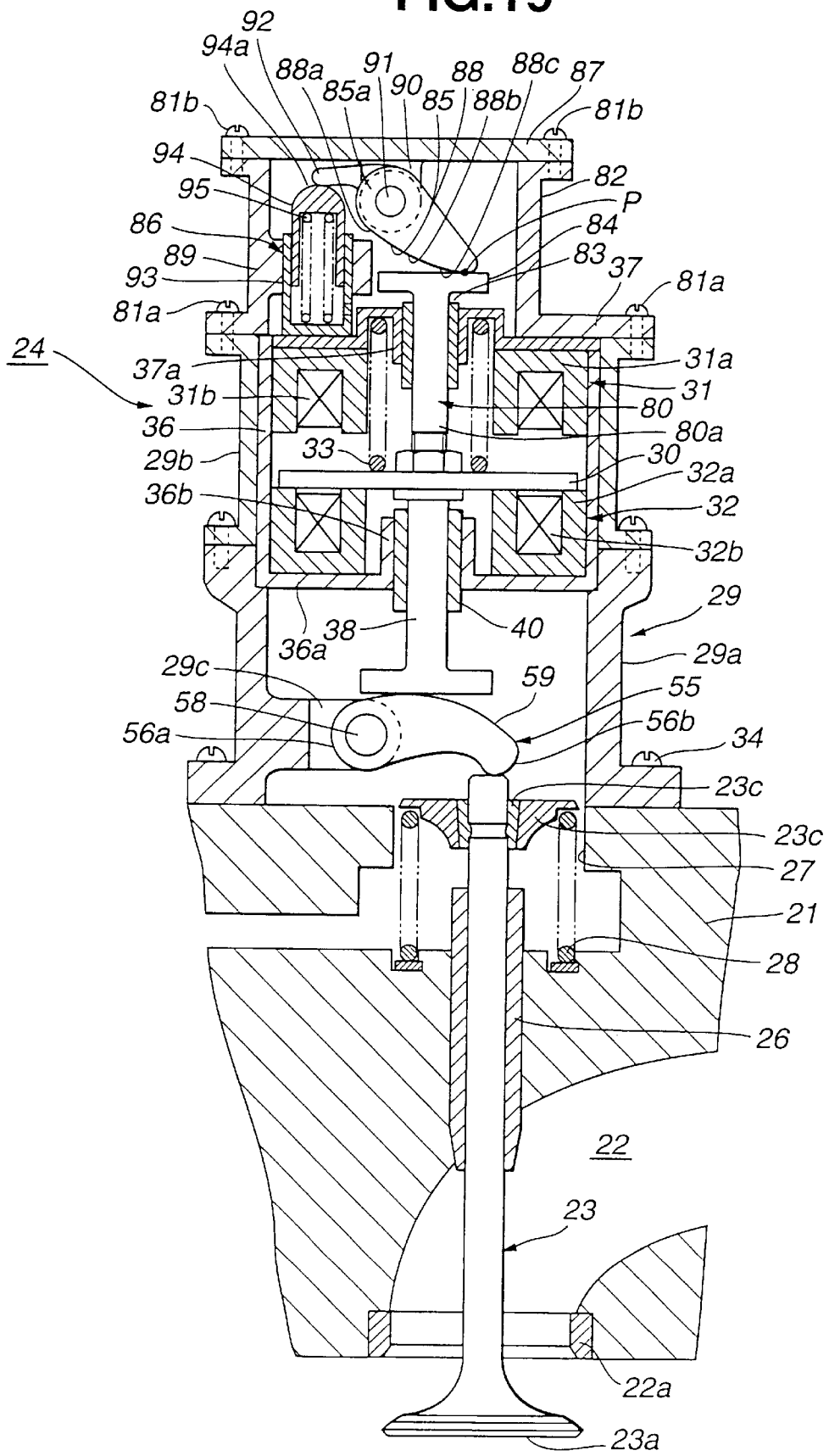
FIG. 19 is a cross-sectional view showing a valve full open state of the third embodiment of FIG. 15.

When the engine is started and when the intake valve 23 is lowered by the spring force of the valve-opening spring 33 and the attracting force of the electromagnet 32 as shown in FIG. 19, the plunger 94 is upwardly moved by the spring force of the coil spring 95, and therefore the second swing cam 85 is rotated clockwise in FIG. 19 through the lever portion 92. Therefore, the second cam surface 88 pushes the second follower member 84 downwardly while varying the contacting position P with respect to the second follower surface 84*a*. This enables the second guide rod 80 to be slidingly lowered following the downward movement of the first guide rod 38. During this valve-opening period, the characteristic of the valve-opening stroke at the terminating period performs a slow and smooth characteristic due to the special function of the first swing cam 55 as mentioned in the second embodiment.

Figure 20:
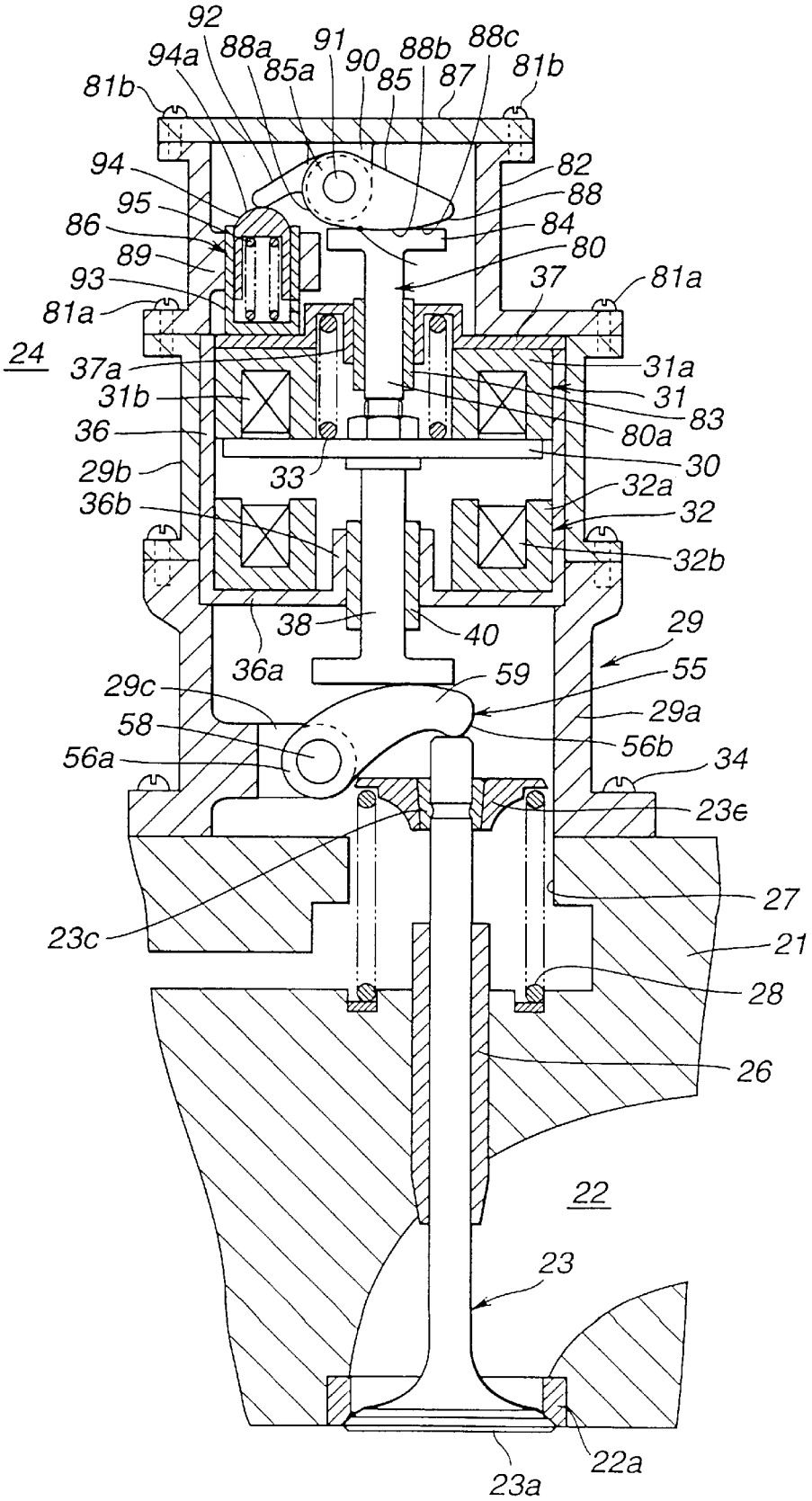
FIG. 20 is a cross-sectional view showing a valve full close state of the third embodiment of FIG. 15.

On the other hand, when the intake valve 23 is closed, the intake valve 23 is basically raised up due to the attracting force of the valve-closing electromagnet 31 and the spring force of the valve-closing spring 28. According to the raising of the armature 30 and the intake valve 23, the second guide rod 80 is also raised up such that the second cam surface 88 of the second swing cam 85 moves on the second follower surface 84*a* of the second follower member 84 while being in contact with the second follower surface 84*a*. Therefore, the contacting position P of the second swing cam 84 with respect to the second follower surface 84*a* is varied from the lift part 88*c* shown in FIG. 19 through the ramp part 88*b* to the base part 88*a* shown in FIG. 20. Since the contacting position P at the terminating period of the valve-closing stroke is very close to the second cam-supporting shaft 91, the intake valve 23 is generally supported by the second cam-supporting shaft 91 through the first swing cam 46, the first guide rod 38 and the second guide rod 80 at this terminating period. By this arrangement and the spring force of the coil spring 95, the radical raising of the intake valve 23 is further suppressed at the terminating period of the valve-closing period. This functions to avoid the collision between the round head 23*a* of the intake valve 23 and the valve seat 22*a*. As a result, the noises and abrasions due to this collision are effectively prevented.

Figure 21:
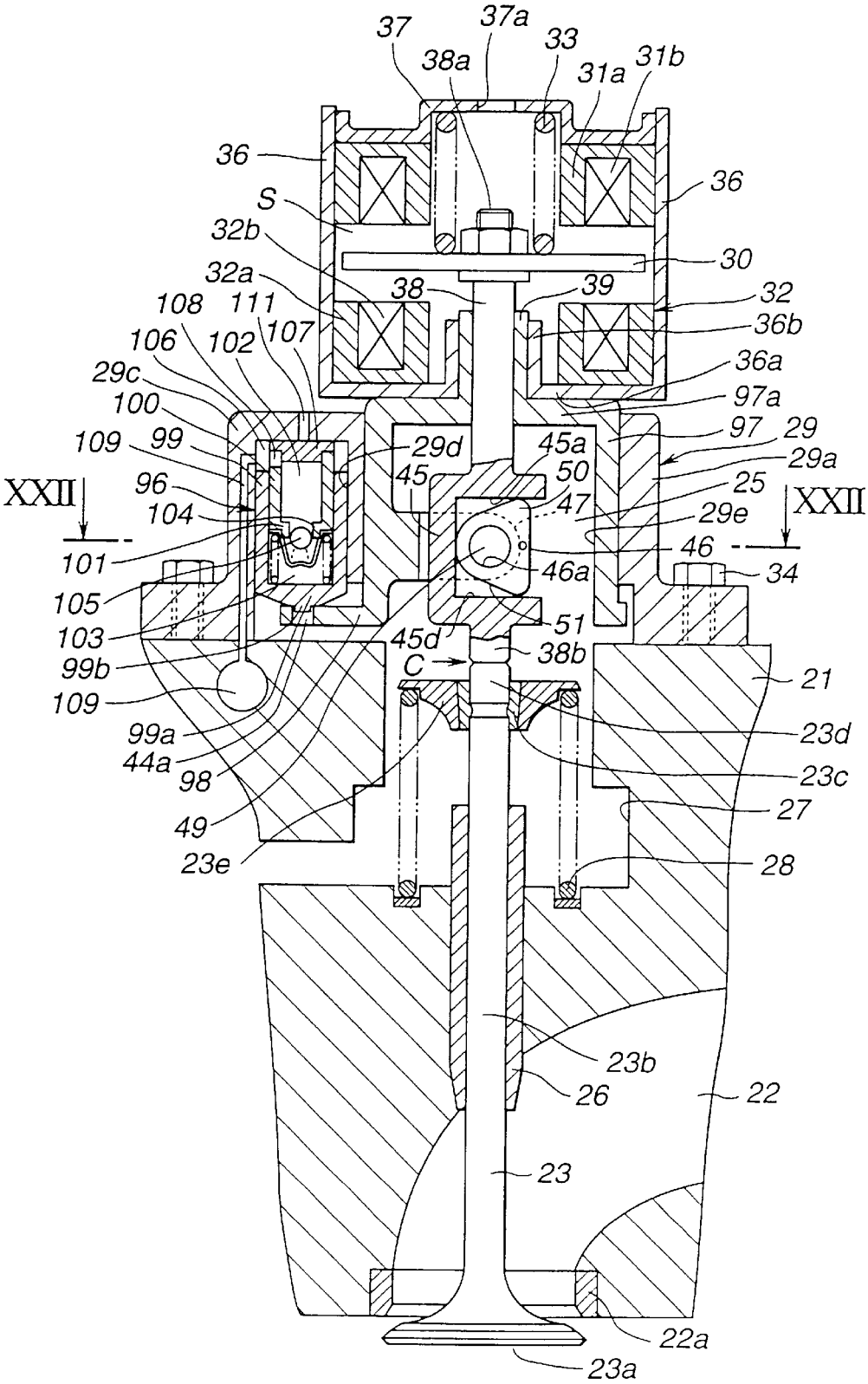
FIG. 21 is a cross-sectional view showing a fourth embodiment of the electromagnetic valve drive system according to the present invention.
Figure 22:
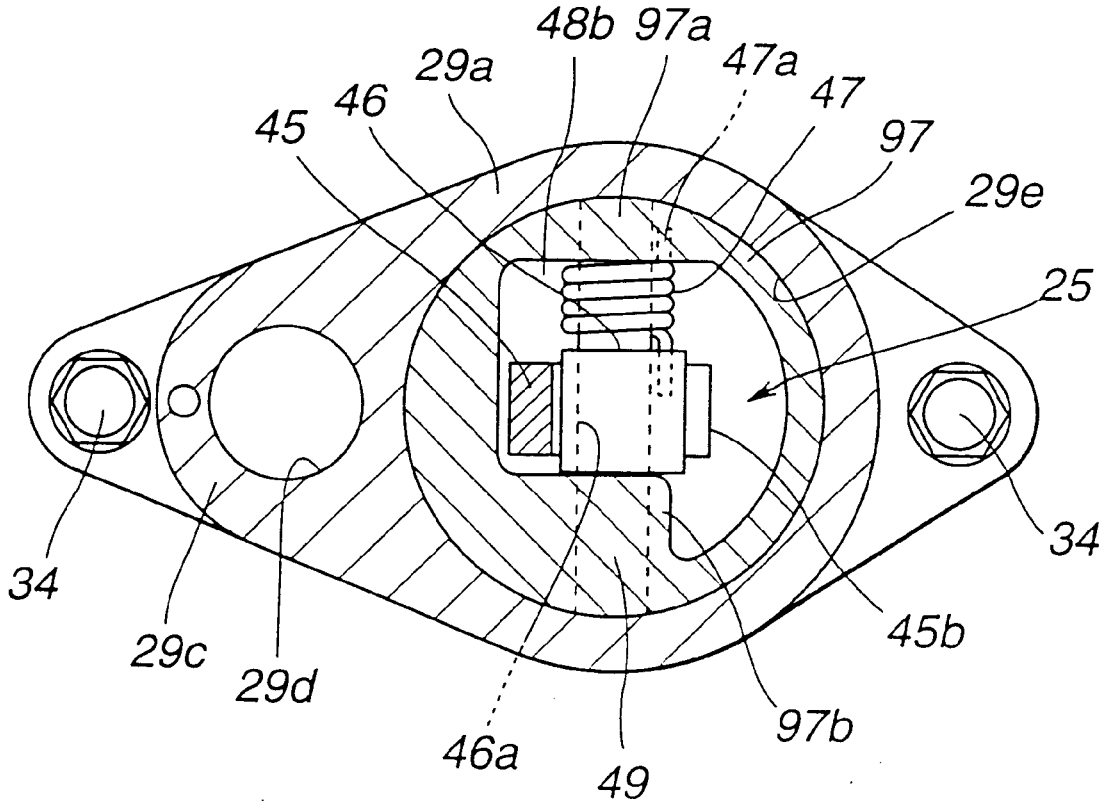
FIG. 22 is a cross-sectional view taken in the direction of arrows substantially along the line XXII—XXII of FIG. 21.

Referring to FIGS. 21 and 22, there is shown a fourth embodiment of the electromagnetic drive system according to the present invention. The fourth embodiment is basically arranged on the basis of the structure of the first embodiment. In addition to the structure of the first embodiment, there is provided a lash-adjuster 96 beside the damper mechanism 25 to adjust a valve clearance C between the lower end portion 38*b* of the guide rod 38 and the stem end 23*d* of the valve stem 23*b* to zero while the intake valve 23 is closing.

More specifically, the cover 29*b* of the casing 29 is not employed in this fourth embodiment, and the casing 29 is constituted only by the main body 29*a*. A boss portion 29*c* is provided at a left side portion of the main body 29*a* as shown in FIG. 21. The boss portion 29*c* has a supporting hole 29*d* opened toward the downward direction.

A slide member 97 of a cup shape is vertically slidably installed in a supporting hole 29*e* of the casing 29. A cylindrical guide portion 39 is integrally connected to a center portion of a disc-shaped upper wall 97*a* of the slide member 97, and is fixed to a cylinder wall 36*b* of the cylindrical holder 36 by inserting the cylindrical guide portion 39 to the cylinder wall 36*b*. The fixing connection fixedly sets the cylindrical holder 36 on the slide member 97. Therefore, the armature 30, the electromagnets 31 and 32, the valve-opening spring 33 and the damper mechanism 25 are integrally interconnected through the slide member 97 and the cylindrical holder 36, and are vertically moved through the main body 29*a*. Further, boss portions 97*b* for supporting a cam-supporting shaft 49 of the swing cam 46 are integrally formed with the slide member 97. The boss portions 97*b* are formed at an inner wall surface 29*e* of the slide member 97 and supports both end portions of the cam-supporting shaft 49. Further, a projecting portion 98 is integrally connected at an outer and lower end portion of the slide member 97. The projecting portion 98 horizontally projects from the outer and lower end portion of the slide member 97 toward the lash-adjuster 96 and is in contact with a lower end portion of the lash-adjuster 96.

The lash-adjuster 96 comprises a plunger 99, a cylindrical member 100, a reservoir chamber 102, a high pressure chamber 103, and a check valve 105. The plunger 99 is disposed in the supporting hole 28*d* to be slidable in the vertical direction therein. The cylindrical member 100 is slidably disposed in the plunger 99. The reservoir chamber 102 and the high pressure chamber 102 are formed inside of the plunger 99 and are divided by a partition wall 101 of the cylinder member 100. A communication hole 104 is formed at the partition wall 101, and the check valve 105 is installed at the communication hole 104 to allow the working fluid flowing from the reservoir chamber 102 to the high pressure chamber 103.

More specifically, the plunger 99 is arranged such that a center projecting portion 99*a* thereof is in contact with an upper surface of the projecting portion 98 and that a projection 99*b* of the center projecting portion 99*a* is engaged with a hole 44*a* of the projecting portion 98. This functions to prevent the slid member 97 and the cylindrical holder 36 from freely rotating. An annular groove 106 is provided between an upper periphery of the plunger 99 and a bottom of the supporting hole 29*b*. A cover 107 is fitted and fixed to an upper opening of the cylinder member 100. A hydraulic passage 108 is provided at an upper periphery of the cylinder member 100 just under the cover 107 to communicate the annular groove 106 and the reservoir chamber 102. The cylinder member 100 is upwardly biased by a spring installed in the high pressure chamber 103.

The reservoir chamber 102 is arranged to receive the working oil from a hydraulic passage 109 provided in the cylinder head 21 through a hydraulic hole 110 in the boss portion 29*c*, the annular groove 106 and the hydraulic passage 108. The check valve 105 is provided with a check ball and a check valve spring biasing the check valve to the communication hole 104. An air-drain hole 111 for ensuring the sliding movement of the plunger 99 and the cylinder member 100 is formed at an upper portion of the boss portion 29*c*.

With the thus arranged electromagnetic drive system of the fourth embodiment according to the present invention, when the engine is stopped, the armature 30 is kept at a neutral position of the clearance S between the electromagnets 31 and 32 due to the balance of the spring forces of the springs 28 and 33 and the turn off of both of the electromagnets 31 and 32, as shown in FIG. 21. Therefore, the intake valve 23 is also kept at a neutral position slightly apart from the valve seat 22*a*. At this moment, since the valve-opening spring 33 pushes up the slide member 97 through the cylindrical holder 36, and therefore the projecting portion 98 applies a push-up force to the plunger 99 of the lash-adjuster 96. However, when the engine has been just stopped, the working oil is sealingly remained in the high pressure chamber 103 by the check ball of the check valve 105. Therefore, the upward movement of the plunger 99 is restricted thereby, and the upward movement of the electromagnetic drive mechanism 24 is also restricted. Thereafter, the working oil remained in the high pressure chamber 103 is gradually leaked according to the elapsed time from the engine stop, and therefore the plunger 99 and the electromagnetic drive mechanism 24 are raised up according to the leakage of the working oil from the high pressure chamber 103. Therefore, the intake valve 23 slightly approaches the valve seat 22*a* from a position shown in FIG. 21, and the armature 30 slightly approaches the valve-opening electromagnet 32.

Thereafter, when the electromagnet 32 is energized according to the start of the engine, the armature 30 is attracted to the electromagnet 32 and is pushed down by the valve-opening spring 33. When the contacting position of the swing cam 46 with respect to the first follower surface 45*a* is moved from the first ramp part 50*b* to the base circular part 50*a*, the speed of the lowering movement is decreased. As a result, the collision between the armature 30 and the valve-opening electromagnet 32 is prevented.

Thus, by the movement of the swing cam 46 from the first ramp part 50*b* to the base circular part 50*a*, the pushing force of the valve-closing spring 28 is applied to the damper mechanism 25 to push up the plunger 99 through the projecting portion 98. However, at this timing, the high pressure is kept in the high pressure chamber 103 to restrict the raising-up of the slide member 97. Therefore, the intake valve 23 is kept at the open state.

On the other hand, when the intake valve 23 is closed, the armature 30 is attracted by the valve-closing electromagnet 31, and simultaneously the intake valve 23 is raised up by the spring force of the valve-closing spring 28 so as to be put on the valve seat 22*a*.

In this case, since the attracting force of the valve-closing electromagnet 31 is cancelled by the spring force of the valve-opening spring 33, no vertical force is applied to the slide member 97. Therefore, the slide member 97 is pushed down by the pushing force due to the spring force of the lash-adjuster 96 and the hydraulic force of the high pressure chamber 103 through the projecting portion 98. Further, the lower periphery 38*b* of the guide rod 38 is pushed up by the upper end portion 23*d* of the intake valve 23 to adjust the clearance C therebetween at zero. This prevents the collision between the round head 23*a* of the intake valve 23 and the valve seat 22*a*. As a result, noises and abrasions generated by this collision are effectively prevented.

Further, since the base circular portion 51*a* of the second cam surface 51 is in contact with the second follower surface 45*b* at this timing, the collision between the valve-closing electromagnet 31 and the armature 30 is avoided, and the armature 30 is located in the vicinity of the valve-closing electromagnet 31 while having a gap at which the valve-closing electromagnet 31 can generate an electromagnetic attracting force greater than the spring force of the valve-opening spring 33.

Since the positions of the guide rod 38 and the electromagnetic drive mechanism 24 at the valve closing state are automatically adjusted by the lash-adjuster 96, even if the thermal expansion of the intake valve 23 and the abrasion of the valve seat 22*a* are generated, the intake valve 23 is properly opened and closed while avoiding a collision to the valve seat 22*a*. Specifically, since the electromagnetic drive system of the fourth embodiment is arranged to maintain the clearance C between the upper end portion 23*d* of the valve stem 23*b* and the lower periphery 38*b* of the guide rod 38 at zero, it is possible to prevent noises caused by the collision between the valve stem 23*b* and the guide rod 38.

Furthermore, the lash-adjuster 96 is disposed at a position which is not coaxial with the intake valve 23 and the guide rod 38 and is parallel with the guide rod 38 so as not to interlock with the intake valve 23. Therefore, it is possible to stably and certainly ensure the performance of the lash-adjuster 96 without increasing the inertia mass of the intake valve 12 and the armature system. Further, since the lash-adjuster 96 is arranged so as not to interlock with the intake valve 23, slide resistance due to abrasion at an outer periphery of the lash-adjuster 96 is prevented from generating.

Further, since the lash-adjuster 96 is arranged parallel with the damper mechanism 25, it is possible to suppress this system from becoming high in height so as to keep its compactness. This maintains the installation ability of the engine equipped with this system to a vehicle.

Additionally, the electromagnetic drive system of the fourth embodiment is arranged such that the armature 30, the electromagnets 31 and 32 of the electromagnetic drive mechanism 24 and the follower member 45 and the swing cam 46 of the damper mechanism 25 are interlocked with each other and are integrally unified, in order to integrally move these unified elements vertically. Therefore, it becomes possible to set the clearance C at zero while maintaining the interlock between the damper mechanism 25 and the electromagnetic drive mechanism 24 including the armature 30 and the electromagnets 31 and 32. Accordingly, it becomes possible to adjust the valve clearance in high accuracy. More specifically, when the variation of the valve clearance is adjusted to zero by means of the lash-adjuster 96, the electromagnets 31 and 32 are integrally moved in vertical direction with the damper mechanism 25 and the armature 30, and the relative clearance between the armature 30 and each of the electromagnets 31 and 32 is not varied. Therefore, it is possible to further finely control the valve clearance.

Although the embodiments according to the present invention have been shown and described such that the electromagnetic drive system according to the present invention is applied to an intake valve, it will be understood that the invention is not limited to this and may be applied to an exhaust valve of engines. If the electromagnetic drive system of the present invention is applied to an exhaust valve, the electromagnetic drive system according to the present invention functions to suppress radical discharging of exhaust gases by restricting the radical movement in the valve opening timing. This enables the reduction of a level of exhaust sounds.

The entire contents of Japanese Patent Application No. 11-176321 filed on Jun. 23, 1999 in Japan are incorporated herein by reference.

Although the invention has been described above by reference to certain embodiments of the invention, the invention is not limited to the embodiments described above. Modifications and variations of the embodiments described above will occur to those skilled in the art, in light of the above teachings.

What is claimed is:

1. An electromagnetic drive system for repeatedly opening and closing a valve of an internal combustion engine, comprising:

an electromagnetic drive mechanism comprising a pair of electromagnets, an armature disposed between the pair of electromagnets and a pair of springs setting the armature at a neutral position between the electromagnets when both the electromagnets are de-energized, the electromagnets being alternately energized and de-energized according to a control signal; and damper means for damping a speed of displacement of the valve at a terminating period of each of a valve-closing stroke and a valve-opening stroke of the valve, said damper means being interlocked with said electromagnetic drive mechanism, wherein said damper means includes a follower and having a cam, the cam being moved on a surface of the follower while being in contact with the surface of the follower when the armature is moved between the electromagnets.

2. An electromagnetic drive system for repeatedly opening and closing a valve of an internal combustion engine, comprising;

an electromagnetic drive mechanism comprising a pair of electromagnets, an armature disposed between the pair of electromagnets and a pair of springs setting the armature at a neutral position between the electromagnets when both the electromagnets are de-energized, the electromagnets being alternately energized and de-energized according to a control signal; and a damper mechanism interlocked with said electromagnetic drive mechanism, said damper mechanism damping a speed of displacement of the valve at a terminating period of each of a valve-closing stroke and a valve-opening stroke of the valve, wherein said damper mechanism includes a follower and a cam, the cam being moved on a surface of the follower while being in contact with The surface of the follower when the armature is moved between the electromagnets.

3. An electromagnetic drive system for a valve of an internal combustion engine, comprising:

an electromagnetic drive mechanism comprising an armature interlocked with the valve, a valve-closing electromagnet energized to attract the armature in a valve closing direction, a valve-opening electromagnet energized to attract the armature in a valve opening direction, a valve-closing spring applying a force directed to the valve closing direction to the valve, and a valve-opening spring applying a force directed to the valve opening direction to the armature, the armature being set at a neutral position of a movable range of the armature due to the forces of the valve-closing spring and the valve-opening spring when both the electromagnets are de-energized; and a damper mechanism comprising a swing cam and a follower member, the follower member being interlocked with the armature, the swing cam being swingably installed to a casing installed to a cylinder head of the engine, the swing cam being swung on a surface of the follower member to vary a speed of displacement of the valve at a terminating period of each of a valve-closing stroke and a valve-opening stroke of the valve.

4. An electromagnetic drive system for repeatedly opening and closing a valve of an internal combustion engine, comprising:

an electromagnetic drive mechanism comprising a pair of electromagnets, an armature disposed between the pair of electromagnets and a pair of springs setting the armature at a neutral position between the electromagnets when both the electromagnets are de-energized, the electromagnets being alternately energized and de-energized according to a control signal; and a damper mechanism interlocked with said electromagnetic drive mechanism, said damper mechanism decreasing a speed of displacement of the valve at a terminating period of each of a valve-closing stroke and a valve-opening stroke of the valve, wherein said damper mechanism includes a follower member having a follower surface and a swing cam supported to a cylinder head of the engine through a casing, the follower member being interlocked with the armature, the swing cam being moved on the follower surface while being in contact with the follower surface when the armature is moved between the electromagnets.

5. An electromagnetic drive system as claimed in claim 4, further comprising a control unit which outputs the control signal to said electromagnetic drive mechanism.

6. An electromagnetic drive system as claimed in claim 4, wherein the pair of electromagnets of said electromagnetic drive mechanism includes a valve-opening electromagnet energized to open the valve and a valve-closing electromagnet energized to close the valve.

7. An electromagnetic drive system as claimed in claim 4, wherein said damper mechanism is disposed between said electromagnetic drive mechanism and the valve.

8. An electromagnetic drive system as claimed in claim 4, wherein said follower member is a disc-shaped follower member having a first follower surface and a second follower surface, and said swing cam is a first swing cam in contact with the first follower surface and a second swing cam in contact with the second follower surface, the disc-shaped follower member being connected to the armature through a guide rod.

9. An electromagnetic drive system as claimed in claim 8, wherein said damper mechanism further comprises a biasing mechanism for always elastically biasing a cam surface of the second swing cam to the second follower surface.

10. An electromagnetic drive system as claimed in claim 4, wherein said damper mechanism comprises a first guide rod extending from said armature toward the valve, said follower member is a first follower member connected to an end of the first guide rod, said swing cam is a first swing cam disposed between the first follower member and the end of the valve and being in contact with a first follower surface of the first follower member and the end of the valve, a second guide rod extending from said armature in a direction opposite to a first guide rod extending direction, a second follower member connected to an end of the second guide rod, a second swing cam in contact with a second follower surface of the second follower member.

11. An electromagnetic drive system as claimed in claim 10, wherein said damper mechanism further comprises a biasing mechanism for always elastically biasing a second cam surface of the second swing cam to a second follower surface of the second follower member.

12. An electromagnetic drive system as claimed in claim 4, further comprising a lash-adjuster for adjusting a valve clearance C between a stem end of the valve and an interlocking end of the electromagnetic valve drive system to the valve.

13. An electromagnetic drive system as claimed in claim 12, wherein said lash-adjuster is disposed parallel with the damper mechanism and the valve.

14. An electromagnetic drive system as claimed in claim 13, wherein a cylindrical casing is fixed on an upper end portion of a cylinder head of the engine, a slide member for supporting said damper mechanism therein being slidably supported to the cylindrical casing, a cylindrical holder for supporting the armature and the electromagnets being connected to an upper end portion of the slide member, said damper mechanism and said electromagnetic drive mechanism being integrally arranged through the cylindrical holder and the slide member, the lash-adjuster being disposed in said casing, the cylindrical holder and the slide member being integrally slid by the operation of the lash-adjuster.

15. An electromagnetic drive system as claimed in claim 6, wherein the follower member includes a channel shaped portion having a pair of follower surfaces on which a cam surface of the swing cam moves according to the movement of the armature.

16. An electromagnetic drive system as claimed in claim 15, wherein the cam surface of the swing cam includes a base part near a shaft supporting the swing cam, a slight clearance being made between the armature and each of the electromagnets when one of the follower surfaces of the follower member is in contact with the base part of the cam surface.

17. An electromagnetic drive system as claimed in claim 6, wherein said damper mechanism further comprises a torsional coil spring which positions the swing cam at a neutral position in a swingable range of the swing cam.

* * * * *